US007401654B2

(12) United States Patent
Franklin

(10) Patent No.: US 7,401,654 B2
(45) Date of Patent: Jul. 22, 2008

(54) BLOWOUT PREVENTER TESTING SYSTEM

(75) Inventor: Charles M. Franklin, Katy, TX (US)

(73) Assignee: BP Corporation North America Inc., Warrenville, IL (US)

( * ) Notice: Subject to any disclaimer, the term of this patent is extended or adjusted under 35 U.S.C. 154(b) by 201 days.

(21) Appl. No.: 11/025,415

(22) Filed: Dec. 22, 2004

(65) Prior Publication Data

US 2005/0269079 A1 Dec. 8, 2005

Related U.S. Application Data

(60) Provisional application No. 60/532,510, filed on Dec. 26, 2003.

(51) Int. Cl.
*E21B 47/06* (2006.01)
*E21B 47/10* (2006.01)

(52) U.S. Cl. ..... 166/337; 166/250.08

(58) Field of Classification Search ..... 166/250.01, 166/85.4, 336, 337, 250.08; 173/152.71
See application file for complete search history.

(56) References Cited

U.S. PATENT DOCUMENTS 6,321,596 B1 * 11/2001 Newman ..... 73/152.45
2003/0000693 A1 * 1/2003 Couren et al. ..... 166/66

* cited by examiner

*Primary Examiner*—Giovanna C. Wright
(74) *Attorney, Agent, or Firm*—James A. Gabala

(57) ABSTRACT

A method and apparatus is disclosed for testing a blowout preventer (BOP) by: using a drillpipe to install a test plug into one end of the throughbore of a (BOP); using a valve in the BOP to isolate the opposite end of the throughbore of the BOP, using piping to connect the output of a cementing unit to the throughbore of the BOP; using the cementing unit to increase the pressure in the throughbore of the BOP to a predetermined level; displaying the pressure in the piping as a function of time; and displaying the pressure in the piping as a function of time for the same blowout preventer system at an earlier time when leakage was deemed to be within predetermined acceptable limits. The pressure decline caused by a leak can be detected reliably and efficiently with high-resolution pressure data.

11 Claims, 18 Drawing Sheets

Manifold Test

| Test Number | Low psi Minutes | High psi Minutes | Beg. Deg. F | Max. Deg. F | Final Deg. F | Comments |
|---|---|---|---|---|---|---|
| 1 | 10 | 25 | 93.3 | 99.7 | 92.1 | |
| 2 | 13 | 19 | 89 | 95.3 | 90.9 | |
| 3 | 7 | 24 | 88.3 | 94.6 | 90.4 | |
| 4 | 6 | 24 | 88.2 | 94.6 | 90.1 | |
| 5 | 7 | 13 | 87.8 | 93.9 | 89.9 | |
| 6 | 7 | 22 | 87.9 | 91.4 | 89.3 | |
| 7 | 6 | 17 | 87.6 | 92.1 | 89.8 | |
| 8 | 7 | 18 | 88.3 | 91.9 | 89.6 | |
| 9 | 6 | 15 | 89.3 | 92.7 | 90.2 | |
| 10 | 7 | 20 | 88.8 | 92.5 | 89.8 | |
| 11 | 7 | 29 | 88.3 | 94.5 | 89.3 | Retest of #4 |
| 12 | 3 | 30 | 88.4 | 94.1 | 88.4 | Retest of #4 |
| Averages | 7.2 | 21.3 | 88.8 | 93.9 | 90.0 | |

Potential Time Savings (Manifold)

12 tests avg 7.2 mins.
Low psi: 12(7.2-3)x12 = 50 mins.

12 tests avg. 21.3mins
High psi: 12(21.3-3) = 220 mins.

Total 4.5 hours

BOP Test

| Test Number | Low psi Minutes | High psi Minutes | Beg. Deg. F | Max. Deg. F | Final Deg. F | Comments |
|---|---|---|---|---|---|---|
| 1 | 6 | 50 | 92.7 | 104.2 | 91.4 | |
| 2 | 8 | 45 | 89.4 | 109.4 | 91.5 | |
| 3 | 11 | 30 | 89.0 | 110.6 | 99.4 | |
| 4 | 6 | 36 | 90.1 | 109.4 | 93.0 | |
| 5 | 6 | 26 | 90.0 | 105.4 | 93.5 | |
| 6 | 6 | 27 | 100.7 | 108.2 | 94.9 | |
| 7 | 8 | 36 | 95.6 | 110.7 | 94.1 | |
| 8 | 6 | 45 | 91.5 | 117.2 | 96.4 | |
| 9 | 6 | 26 | 91.9 | 126.7 | 101.6 | |
| 10 | 4 | 16 | 94.6 | 108.2 | 100.5 | |
| 11 | 4 | 42 | 94.5 | 97.1 | 93.4 | Retest #10 |
| Averages | 6.5 | 34.5 | 92.7 | 109.7 | 95.4 | |

Potential Time Savings (BOP)

10 High psi tests avg 34 mins.

10(34 - 5) = 290 mins

Total 4.8 hours

Savings on 1 test *9.3 hours

*This does not include the time savings of eliminating re-tests based on a suspect chart.

FIG. 15

BLOWOUT PREVENTER TESTING SYSTEM

CROSS-REFERENCE TO RELATED APPLICATIONS

This is a Patent Application claiming the priority of a USA Provisional Patent Application filed on Dec. 26, 2003 under Ser. No. 60/532,510 and entitled "Blowout Preventer Testing System"

TECHNICAL FIELD

This invention relates to the general subject of production of oil and gas and, in particular to methods and apparatus for testing fluid systems.

STATEMENT REGARDING FEDERALLY SPONSORED RESEARCH OR DEVELOPMENT

Not applicable

REFERENCE TO A MICROFICHE APPENDIX

Not applicable

BACKGROUND OF THE INVENTION

The challenges of obtaining valid Blowout Preventer (BOP) pressure tests in an efficient manner have increased due to greater water depths, deeper drilling horizons, and higher test pressures. FIG. 1 shows the important components involved in testing a subsea BOP stack. A drill string tool or test plug is lowered into the interior or throughbore of the BOP and it seats at the lower end of the BOP to seal off the well components further down the wellbore. The system is a pressure vessel comprised of the test line 10 from the Cementing Unit (CU) 12 and the drillpipe 14 from the 13 surface of the rig 16 down to the BOP stack 18 at the mudline 20. In this work, the capacity of the BOP pressure vessel is referred to as the "test volume." A choke line 24 and a kill line 26 connect the throughbore at the interior of the BOP to the CU 12. The valves (e.g., annular preventers, pipe rams, shear rams, etc.) 22 in the BOP stack are tested in sequence by closing each valve and then pumping fluid from the CU into the test volume until a "target pressure" is reached (the "pumping phase"). At the target pressure, pumping stops and the test volume is closed until a test is deemed valid (the "shut-in phase"). In deepwater wells, the duration of the shut-in phase can be as long as 45 minutes when Synthetic Based Muds (SBMs) are used. Pressure testing a BOP with SBM requires lengthy testing times as a result of pressure/volume/temperature (PVT) influences associated with SBM. PVT influences are especially pronounced in deepwater and high-pressure test environments.

In the USA federal regulations state that a test is valid when the required pressure is held steady for 5 minutes ("Oil and Gas Drilling Operation," Subpart D, 30 CFR Ch. II, Jul. 1, 1999 Edition). Data from a BOP test is historically recorded on a four-hour circular chart recorder shown in FIG. 2. Validation of a test based on the pressure trace on a chart recorder is based on individual judgment. Often, a test is repeated when visual inspection of the chart recorder trace deems it invalid. Frequently, test durations are longer than necessary to help ensure a valid test. The basic chart recorder used on a majority of oil rigs today was patented over one hundred years ago (Wittmer, G. X.: "Recording Apparatus for Fluid Meters," U.S. Pat. No. 716,973).

The problem of BOP testing has existed for some time. Considerable time and effort is expended each year to perform BOP tests. Validating each individual pressure test requires excessive time as a result of waiting on a declining pressure to stabilize. The time to stabilization on each test can take hours. In spite of this, BOP testing schemes have not progressed. Actually, the problem has become aggravated with the passage of time because each year more and more testing is conducted using time consuming processes.

SUMMARY OF THE INVENTION

Field experience and anecdotal evidence suggested that test durations are considerably longer with SBM as opposed to Water-based Muds (WBM). Discussion with rig personnel and engineers indicated that although "pressure decay" was recognized as a characteristic deepwater "phenomenon," it had not been examined rigorously. Further analysis implied that the test duration could be significantly optimized if the physical mechanisms that control the pressure/temperature (P-T) response of the test volume during the different phases of testing were identified and quantified. Numerous benefits would flow from a reduction of test duration.

An analysis of real-time pressure/volume/temperature (PVT) data from BOP tests during the pumping and shut-in phases was performed. The PVT behavior that characterizes a valid test and differentiates it from an invalid test (i.e., when there is a leak) was investigated. System response during a valid test for a given configuration (i.e., drillpipe geometry, fluid PVT properties, etc.) should be repeatable and quantifiable. Moreover, the physical mechanisms that govern the observed trends should be identified and explained via the development of a simple theoretical model. Most importantly, the potential impact of this analysis on BOP test methodology was examined. It was theorized that while pressuring up the system, the system was heating up; and subsequently cooling down while holding pressure. As theorized, pressure and temperature gauges confirmed heating up of the fluid in the system as the pressure was increased, and it was evident that the resultant drop in pressure over time was due to the fluid cooling. The excessive time to pressure stabilization was due to the system heat up and subsequent cool down. Real-time digital pressure data during a BOP test allows the operator to differentiate between valid and invalid tests and, simultaneously, reduces the time required to ascertain a valid test.

In accordance with the present invention, a method is provided comprising the steps of: using dill pipe to install a test plug adjacent to the wellhead end of the BOP and in fluid communication with the interior of the piping and the wellhead side of a valve in the BOP; shutting the valve in the BOP against the exterior of the drill pipe; using the cementing unit to increase the pressure in the piping to a predetermined level; displaying the pressure in the BOP as a function of time; and displaying the pressure in the BOP as a function of time for the same blowout preventer system at an earlier time for which leakage was deemed to be within predetermined acceptable limits.

Some of the advantages of the invention include simplicity and its speed. Recent advances in digital technology and the relative ease of data processing with inexpensive personal computer (PC) technology lead to a clear opportunity for improvement in the recording, analysis, and validation of BOP tests.

Numerous other advantages and features of the present invention will become readily apparent from the following detailed description of the invention, the embodiments described therein, from the claims, and from the accompanying drawings.

BRIEF DESCRIPTION OF THE DRAWINGS

FIG. 14 shows the effect of leak size on rate of pressure change during shut-in; and FIG. 15 is a time summary and illustration of potential savings.

DETAILED DESCRIPTION

Figure 1:
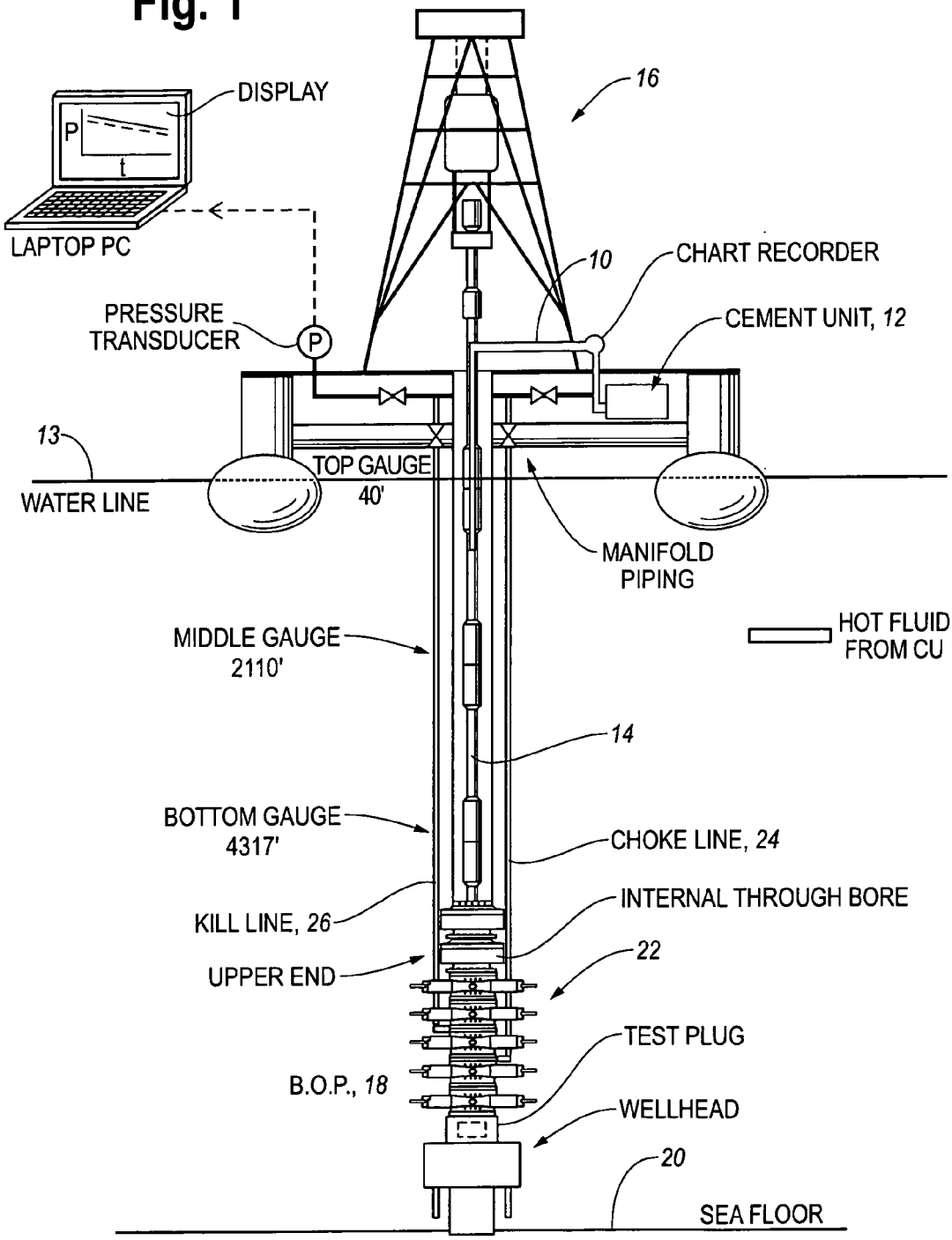
FIG. 1 is a schematic diagram of the of components involved in testing the BOP stack that is the subject of the present invention.

While this invention is susceptible of embodiment in many different forms, there is shown in the drawings, and will herein be described in detail, one specific embodiment of the invention. It should be understood, however, that the present disclosure is to be considered an exemplification of the principles of the invention and is not intended to limit the invention to any specific embodiment so described.

To understand the P-T response of the system, a series of increasingly complex data acquisition exercises was initiated. In each case, real-time PVT data at different points in the test volume was acquired and analyzed. It was originally hypothesized that the fluid in the test volume is heated by compression and heat transfer from the hot fluid added to the system, i.e., the fluid at the CU discharge is significantly hotter than the fluid in the suction tank. When the pressurized system is shut-in, the subsequent cooling of the fluid causes gradual pressure decay, thus extending the time required for a valid test.

Data Analysis and Interpretation

Figure 3:
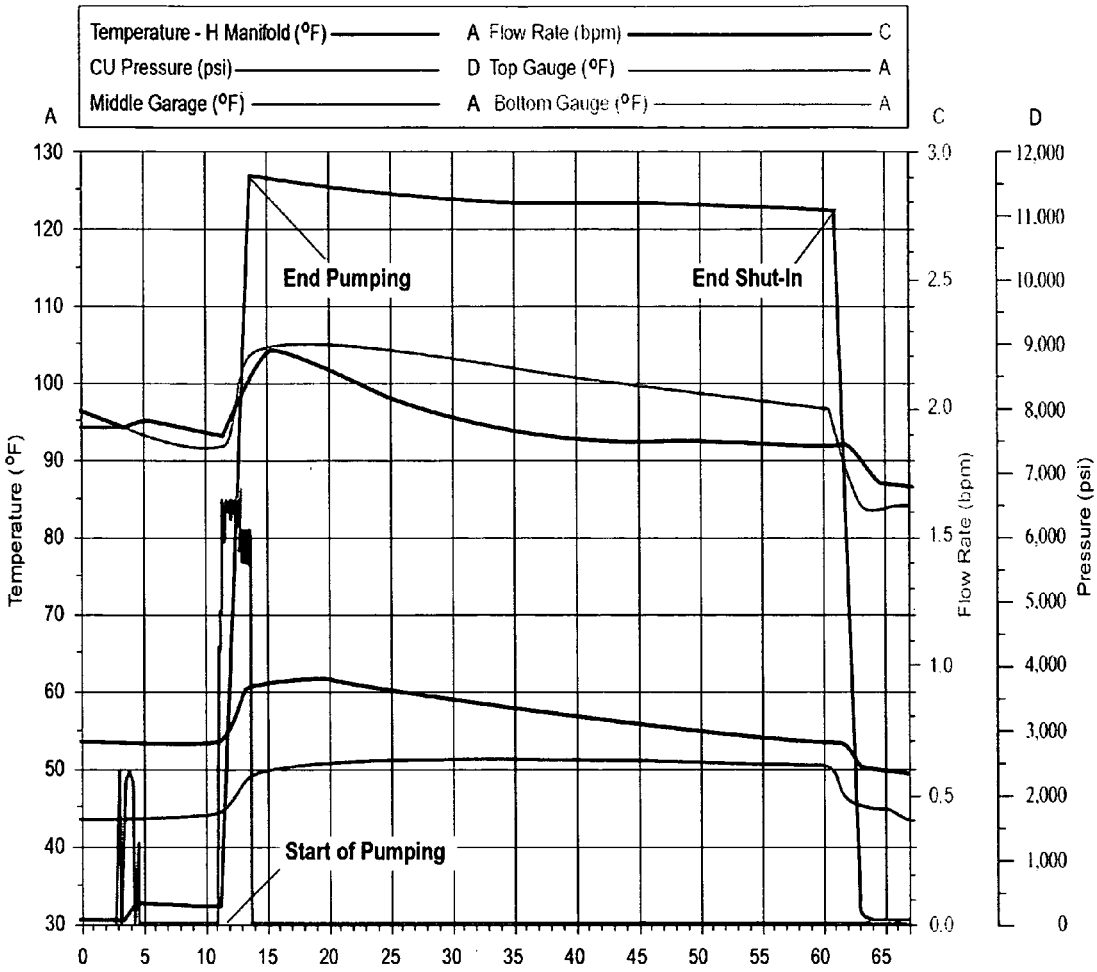
FIG. 3 shows real time pressure and temperature data from a BOP test.

Real-time data obtained from the downhole P-T gauges was analyzed and interpreted. FIG. 3 shows the CU discharge pressure, flow rate, and temperature data recorded by the P-T gauges placed in the drillpipe. In a typical prior art test, the pumping phase lasts for approximately 2½ minutes during which a total of 3.5 to 4 barrels are pumped. For the drillpipe and test line configuration of FIG. 1, the addition of this volume creates a fluid volumetric compressive strain of nearly 3%. During this phase, the pressure increases linearly with respect to volume pumped.

Figure 4:
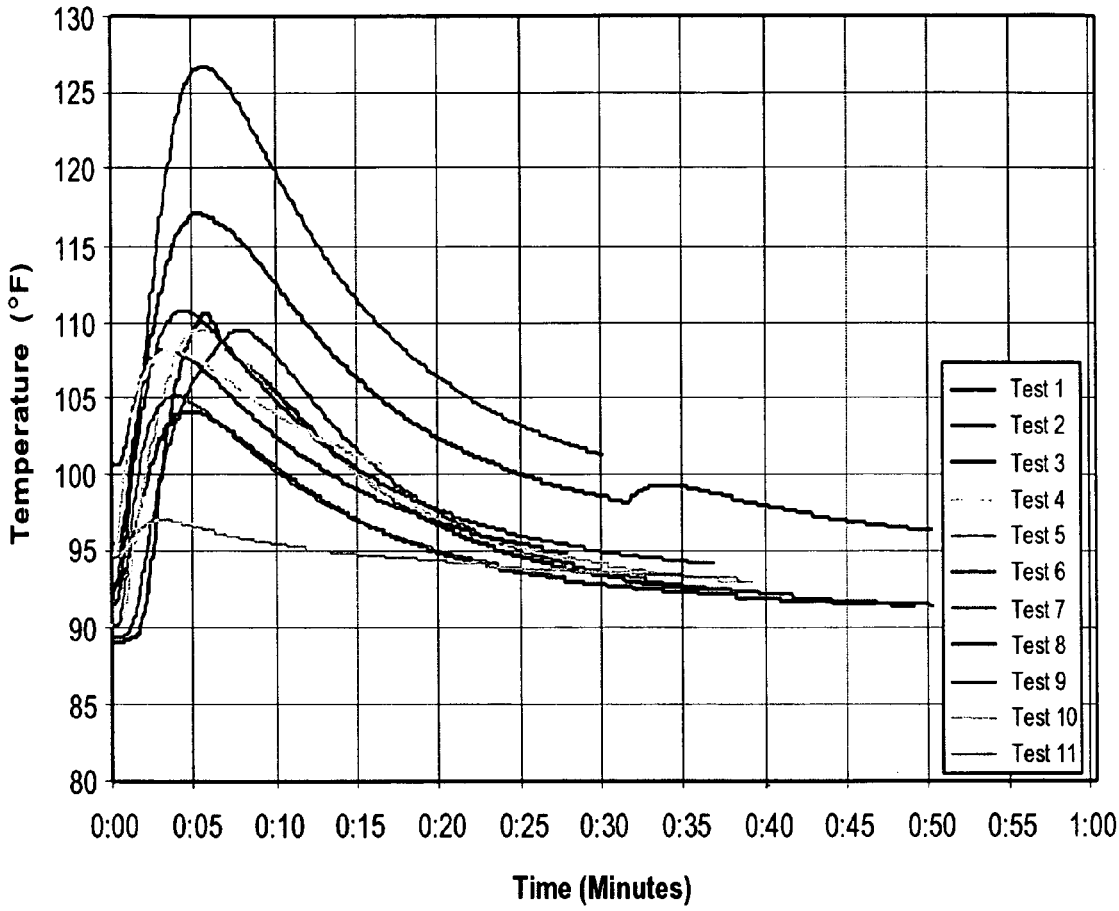
FIG. 4 depicts temperature measured at the CU discharge unit.

A summary of the CU discharge temperatures for the pressure up and shut-in phases for eleven tests is shown in FIG. 4. The temperature of the fluid at the CU discharge varies from 90° F. to 128° F. During the high-pressure tests, the temperature at the CU discharge increased by 19° F. on average. The more fluid pumped, the greater the temperature increase that is observed. Two of the BOP tests (#8 and #9) additionally pressured up the choke line and kill line in which the volume pumped was 8.8 bbl compared to a normal test volume of 3.8 to 4.0 bbl. As shown in FIG. 4, Test #8 records an increase of 25° F., and Test #9 records an increase of 34° F. at the CU discharge.

To potentially mitigate the heating up and cooling down effect, Test #11 used water to pressurize the test volume, although SBM remained in the drillstring. As illustrated in FIG. 4, the rise in water temperature at the CU discharge was less than 3° F. Since 97% of the pressurized test volume still contained SBM, the duration of the shut-in phase of the test was 37 minutes, which is comparable to the duration of the shut-in phase of the other tests.

Figure 5:
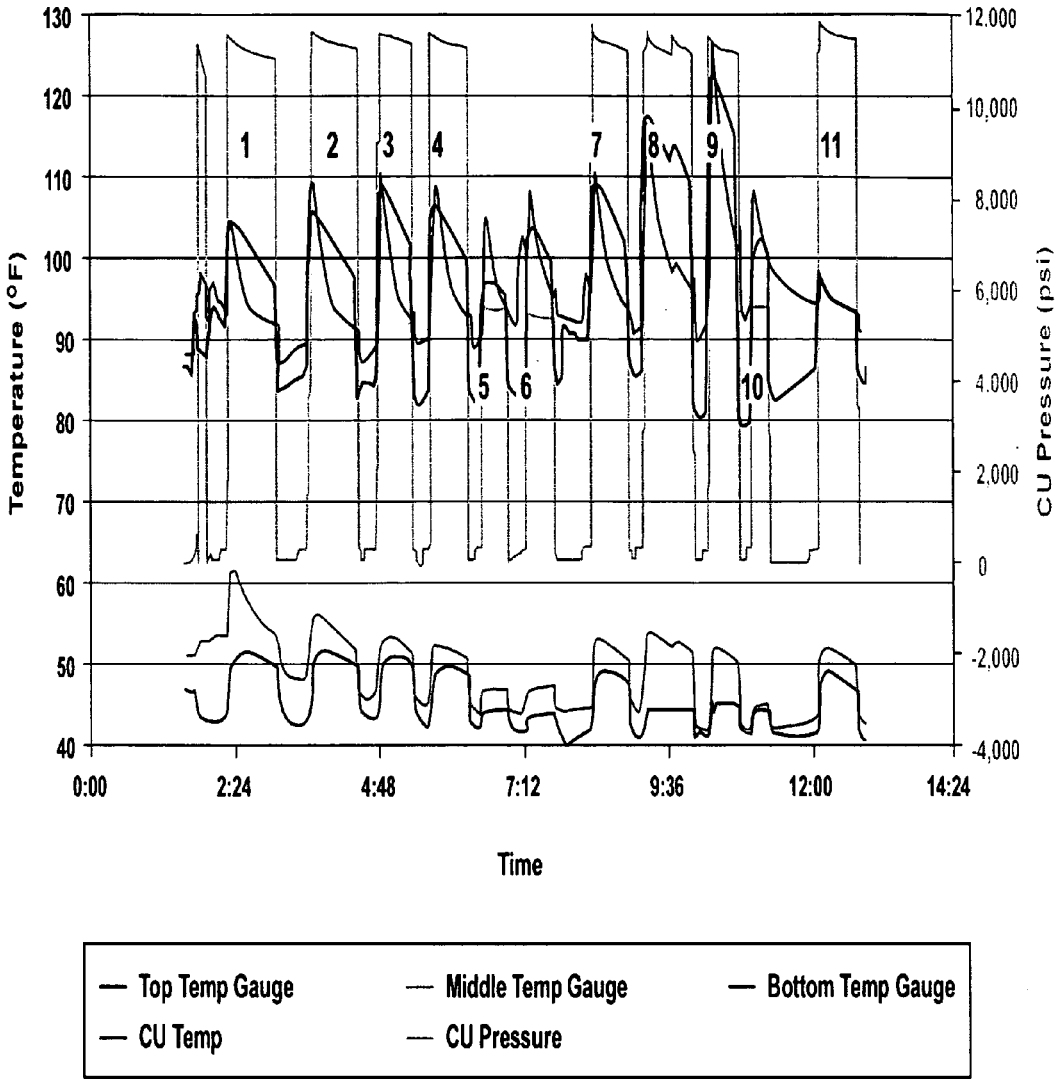
FIG. 5 depicts temperatures measured by the gauges.

FIG. 5 shows the temperature recorded by the P-T gauges in the drillpipe for all eleven tests. To identify individual tests, the pressure at the CU discharge is plotted on the right-hand ordinate. The following features characterize the temperature response of the gauges:

a) At each gauge location, the temperature response approximately mimics the pressure response (i.e., rapid increase during the pumping phase, gradual decay during the shut-in phase, and rapid decrease when the test ends).

b) The temperature decay at the CU discharge during the shut-in phase is much greater than the decay at any of the P-T gauge locations c) The average temperature amplitudes (i.e., difference between the maximum and minimum values of temperature recorded in a given test) at the various locations are as follows:

| | |
|---|---|
| CU discharge | 19° F. |
| Top Gauge | 24° F. |
| Middle Gauge | 7° F. |
| Bottom Gauge | 5° F. |

Note that the minimum temperature at any location is typically recorded at the beginning (just before commencement of pumping), or at the end of the test (when the pressure is released).

The temperature amplitudes at the CU discharge and top gauge are of the same order of magnitude. The amplitudes at the middle and bottom gauges are comparable, but differ significantly from the values at the top gauge and the CU discharge. There are 2.6 bbl of fluid between the CU discharge and the top gauge. Since 3.5 to 3.8 bbl of fluid are added during a typical test, the top gauge is influenced more by the hot fluid pumped rather than the original fluid. Furthermore, the magnitude of the change in volumetric strain is highest at the top of the drillpipe. Therefore, the compressive work per unit volume is a maximum at the top of the fluid column, which explains the significantly higher temperature amplitudes at the top gauge location. The middle and bottom gauges, which are farther away from the pumped fluid, are less prone to the thermal influence (mainly via conduction through the drillpipe and the fluid column) of the incoming hot fluid. Using the middle gauge to represent the temperature increase due to compression, resulting in an increase in internal energy, the average increase was 7° F.

Finally, during the shut-in phase, the rate of change of temperature at the CU discharge (0.39° F./min) is over twice the rate of change at the top gauge location (0.18° F./min). The fluid in the section between the CU and the drillpipe is approximately at a constant temperature, and loses heat by convection to the (isothermal) ambient air. However, the fluid in the drillpipe is subject to the relative insulating effects of the fluid in the drillpipe-riser annulus. Therefore, the rate of cooling inside the drillpipe is less, as evidenced by the relatively similar rates of temperature decay at all three drillpipe P-T gauge locations.

Figure 6:
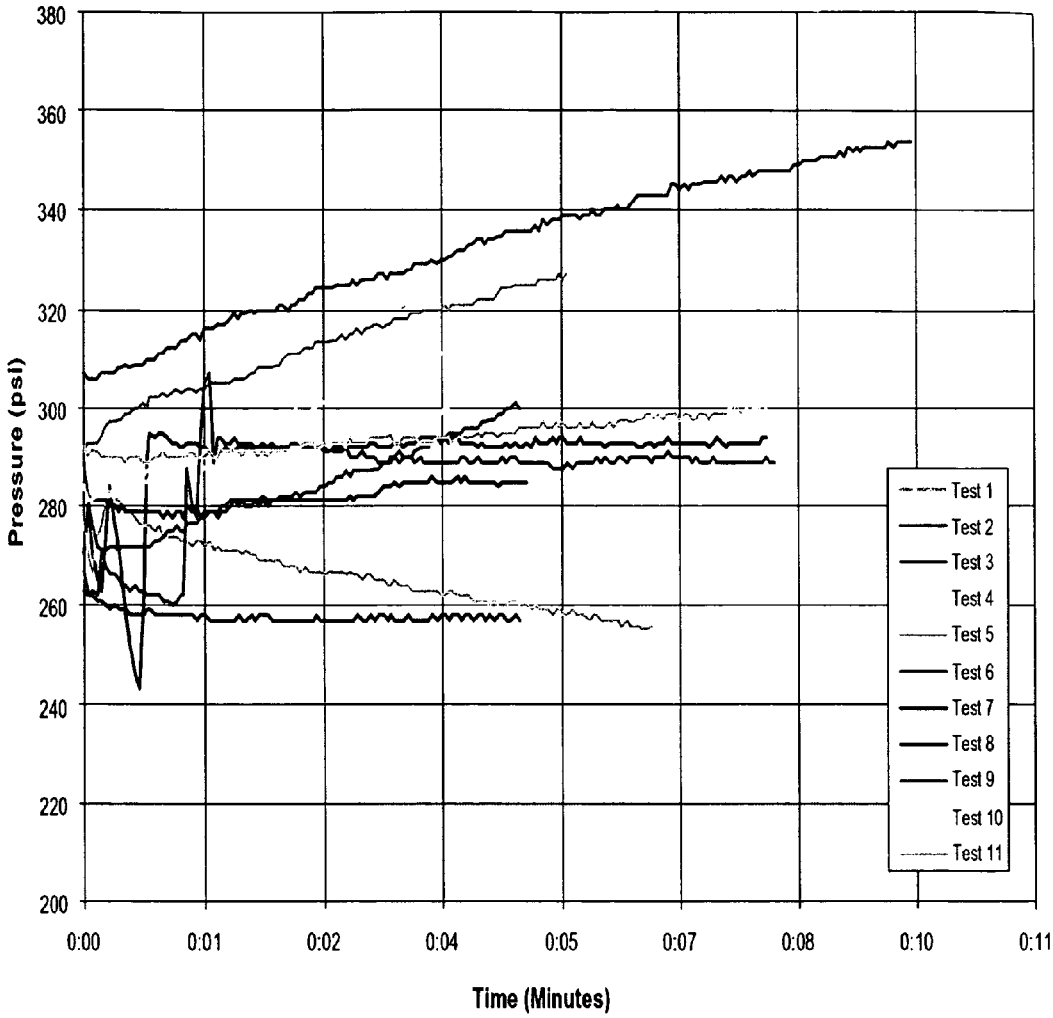
FIG. 6 illustrates a low-pressure test response.

FIG. 6 shows the pressure and temperature at CU discharge for the low-pressure tests, where the target pressures vary from 200 to 300 psi. The figure shows that when pumping stops, the fluid frequently continues to heat up rather than cool down, thus resulting in an increasing pressure. The fluid heat up is a result of heat from the pipe being imparted back into the fluid from the previous high-pressure test, which has heated the pipe.

The fluid temperature increase results from two different mechanisms: pump friction and an increase in fluid internal energy. The pump friction is responsible for heating the fluid from the suction tank as it is being discharged into the test volume. The internal energy of the fluid is related to the thermal states of the fluid molecules. An increase of internal energy usually raises the system's temperature and conversely, a decrease of internal energy usually lowers the system's temperature (Van Wylen, G. J. and Sonntag, R. E.: *Fundamentals of Classical Thermodynamics*, John Wiley and Sons, Inc., New York City, N.Y. (1973).).

Figure 2:
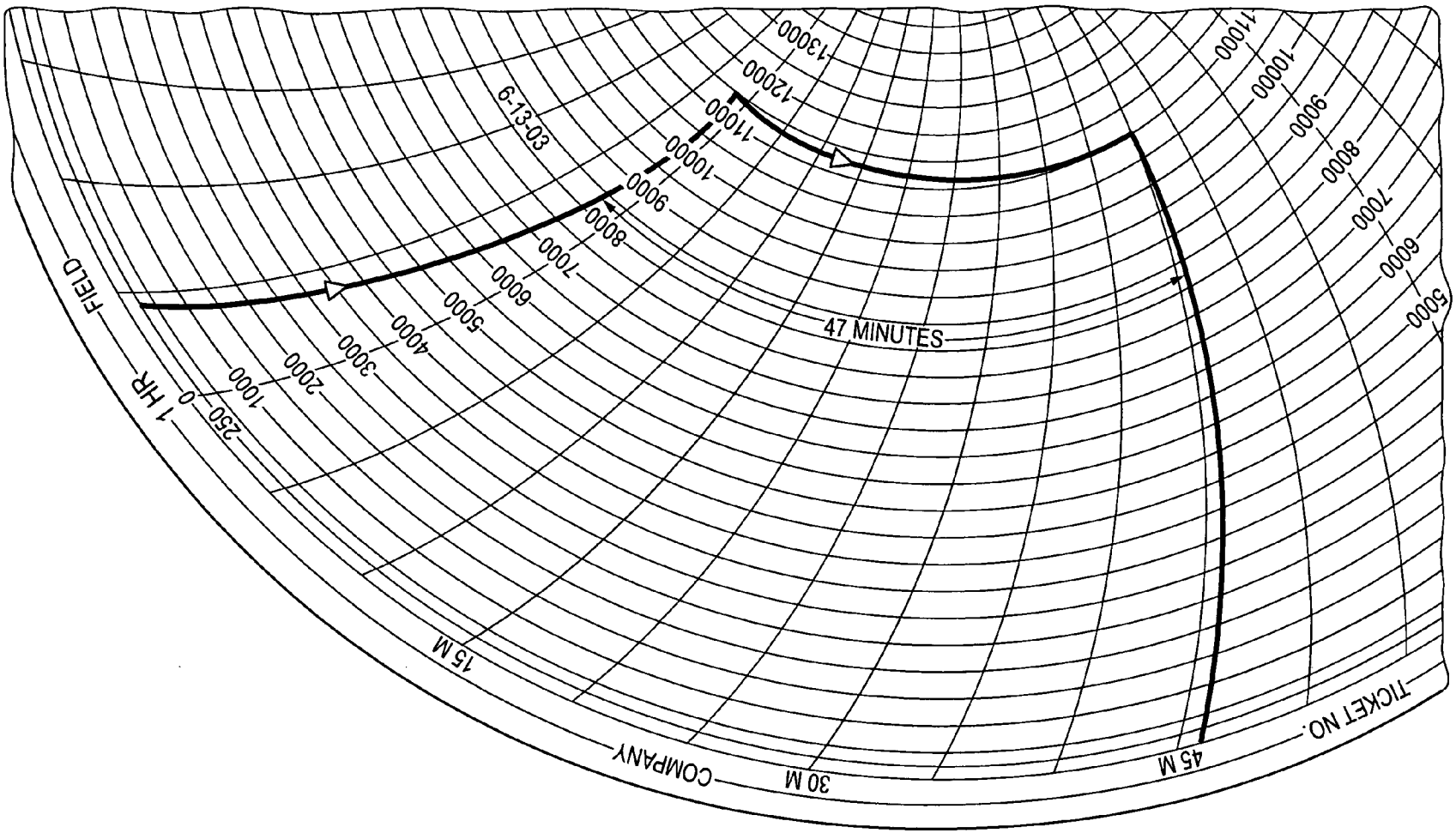
Fig. 2 Prior Art
FIG. 2 is a trace of pressure vs. time on a circular chart recorder used in a BOP test.
Figure 7:
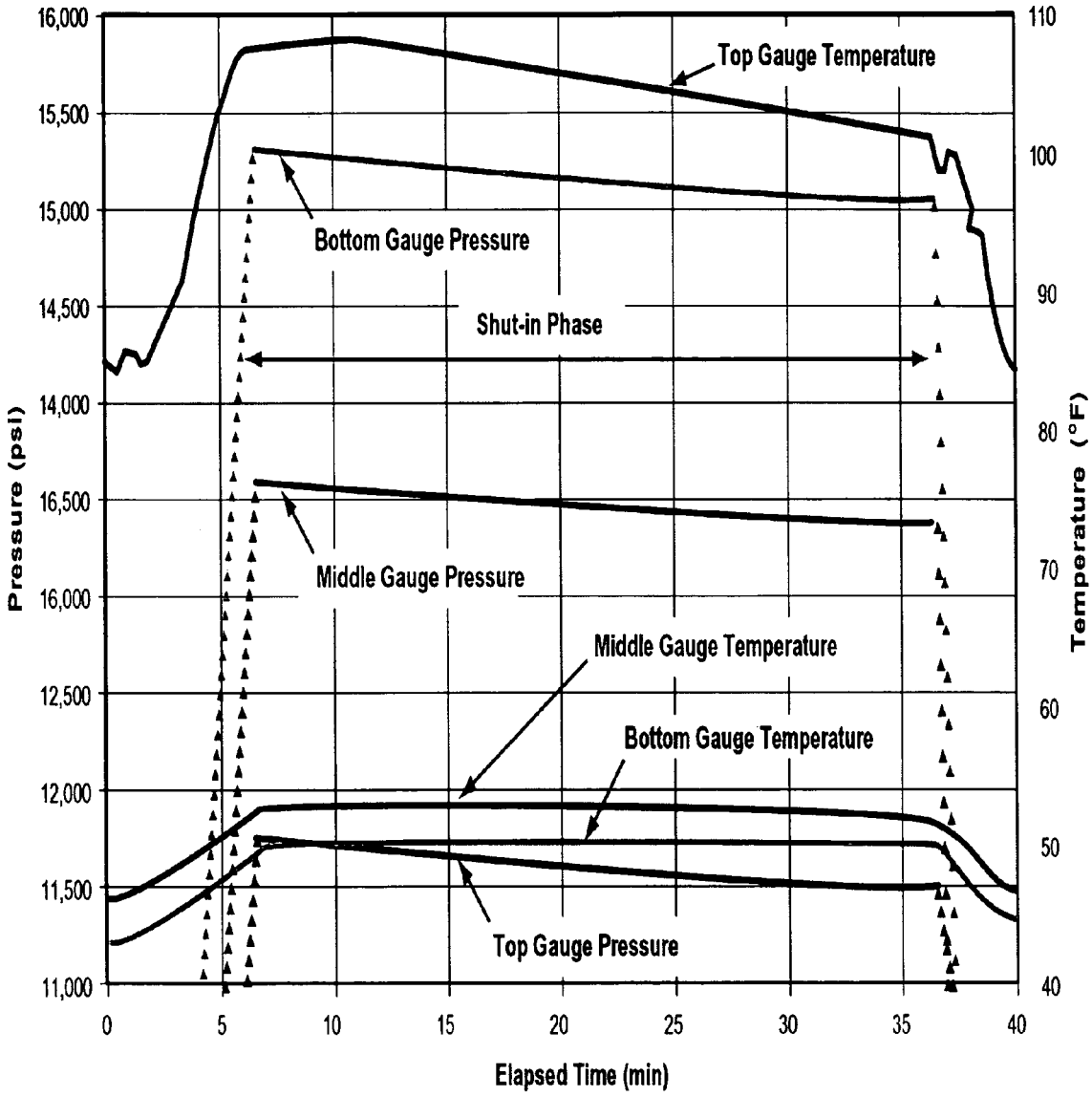
FIG. 7 shows pressure and temperature in the drillpipe during a typical high-pressure test.
Figure 8:
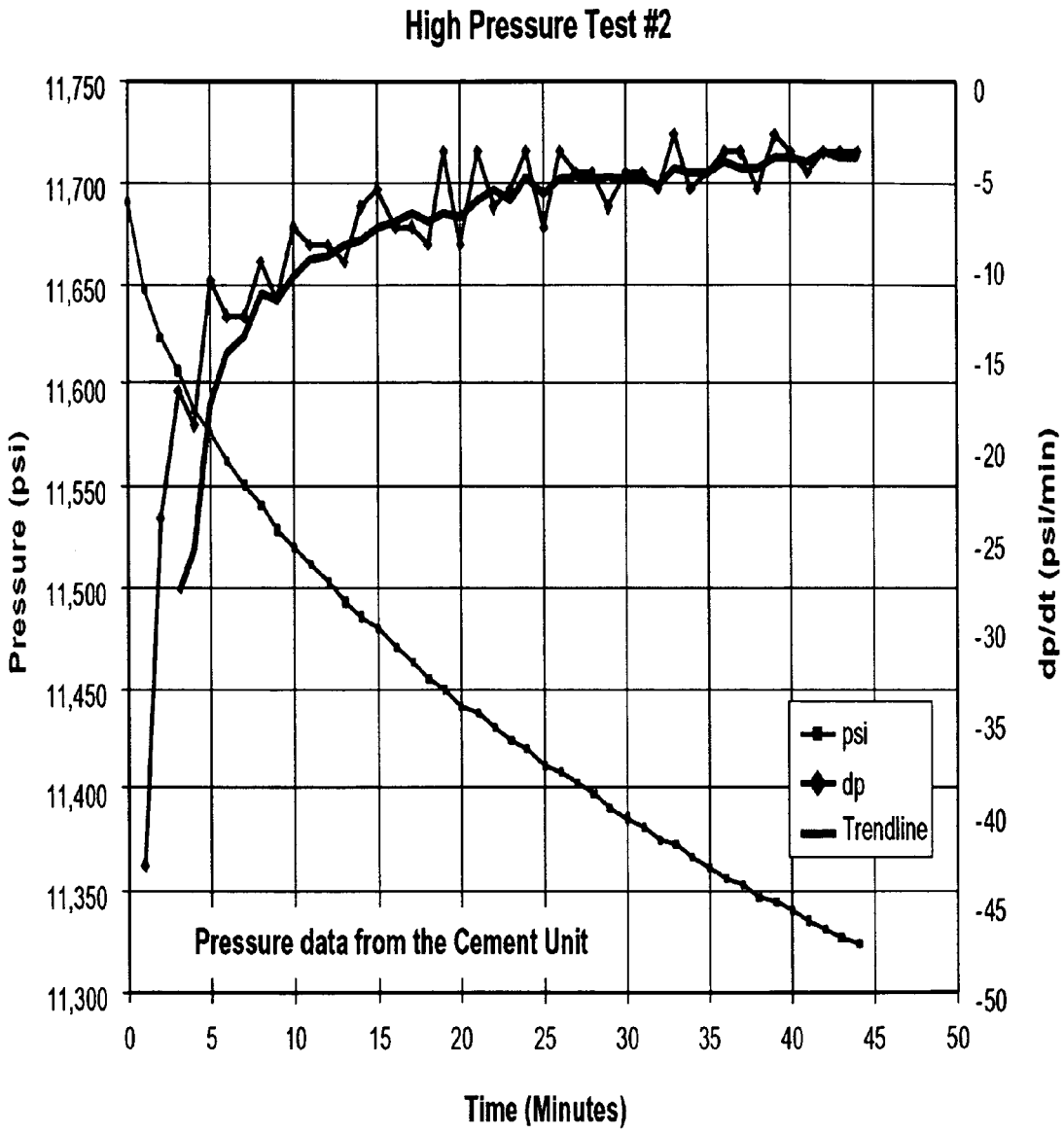
FIG. 8 depicts rate of pressure change during the shut-in phase.

FIG. 7 summarizes the pressure and temperature response in a typical high-pressure test. The figure indicates that the variation of the local pressure and temperature with time are different. When the system is shut-in, the average temperature of the fluid decreases due to a gradual loss of heat (to the ambient sea that surrounds the drillpipe/riser and to the atmosphere at the rig surface), thus resulting in a corresponding decrease in pressure. The pressure appears to stabilize on a circular chart recorder (see FIG. 2) due to the lack of resolution. However, the electronic data (e.g., graphical trend analysis) show the pressure is continuing to decline (see FIG. 8). The derivative curve in FIG. 8 shows pressure continuing to drop at the rate of 4 psi/min at the end of the test. FIG. 8 is based on the fact that as long as the rate of change of the change in pressure is decreasing, the test is valid In summary, the data collected by the downhole P-T gauges indicate the following (see FIG. 5):

1) In the absence of a system leak, the pressure increase in the fluid is proportional to the volumetric (compressive) strain in the fluid. The net volumetric strain in the fluid is a result of the mass added to the system. Therefore, in the absence of a leak, the pressure change per unit volume change of fluid is largely a constant. For a given test volume and fluid, the slope of the pressure vs. volume curve during the pumping phase is a calculable constant. By knowing the PVT behavior of the fluid and other parameters described in Appendix A, the testing process can be modeled.
2) When the system is shut-in, the pressure change is a function of the rate of change of the average fluid temperature. If the rate of change of the average fluid temperature is known, the pressure decay during shut-in can be predicted. This is analogous to calculating annular pressure buildup (APB) in sealed subsea annuli in a wellbore (Halal, A. S. and Mitchell, R. F.: "Casing Design for Trapped Annulus Pressure Buildup," paper SPE/IADC 25694 presented at the 1993 *IADC/SPE Drilling Conference*, and Payne, M. L., Pattillo, P. D., Sathuvalli, U. B., Miller, R. A., and Livesay, R.: "Advanced Topics for Critical Service Deepwater Well Design," presented at 2003 *Deep Offshore Technology* (*DOT*) conference, Marseille, France, November 19-21.). In principle, the average temperature in the fluid can be calculated by knowing: a) the rates of convection from the drillpipe to the sea (via the riser and annular fluid in the drillpipe and riser), b) the ambient marine temperature profile, and c) the temperature profile in the fluid when the system is shut-in.

Such calculations require the identification of variables such as the rates of axial conduction in the drillpipe and fluid, the lateral convection from its surface, the ambient temperature as a function of depth (which can vary depending on sea conditions), and the thermal properties of the drilling mud. The addition of hot fluid heats the original fluid in the drillpipe and determines the temperature profile in the fluid when it is shut-in. However, the net average temperature of the fluid decreases monotonously after shut-in. A predictive model to determine the rate of change of average fluid temperature requires careful understanding of the heat transfer mechanisms during the pumping phase and immediately after shut-in.

Most deepwater drilling muds are emulsions containing synthetic-base fluids, brine phases, and weighting agents. Thermal properties of the individual components of the mud system and the emulsion are not well understood. Recently, the necessity to manage and mitigate APB in subsea wells has led to the study and documentation of the state equations that describe the behavior of SBM (Zamora, M., Broussard, P. N., and Stephens, M. P.: "The Top Ten Mud-Related Concerns in Deepwater Drilling," paper SPE 59109 presented at the 2000 *SPE International Petroleum Conference and Exhibition*, Villa Hermosa, Mexico, February 1-3.). However, data on the thermophysical properties (i.e., specific heat and thermal conductivity, etc.) of the base fluids and brines that comprise the SBM is still lacking.

Nevertheless, order of magnitude analyses and careful examination of data indicate that the rate of change of pressure with time is a system characteristic.

Methodology for Test Validation

Figure 9A:
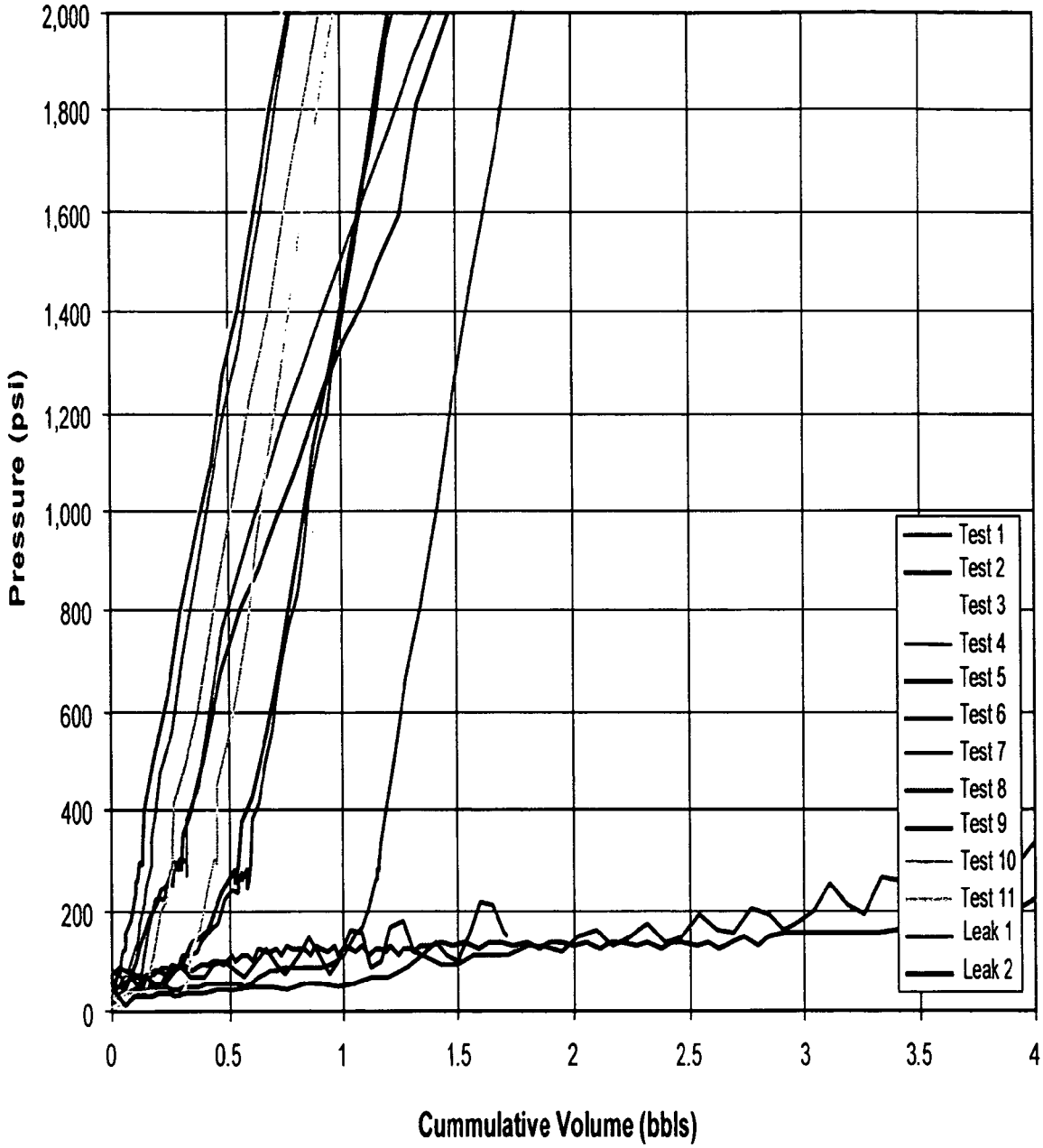
FIGS. 9A and 9B illustrate leak detection during the pumping phase.
Figure 9B:
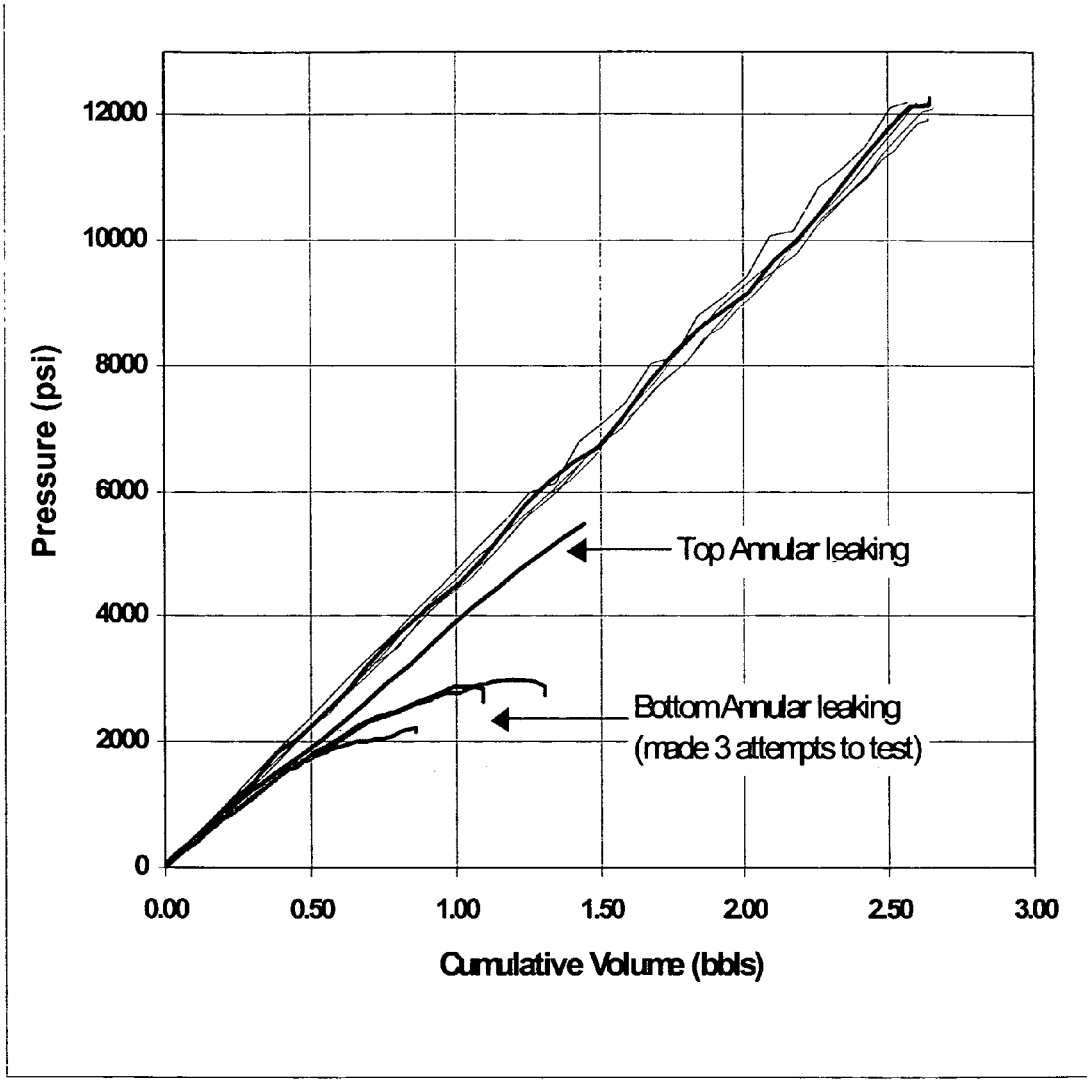

Analysis of the electronic/digital data provided insight towards a methodology for validating a BOP test during the pumping and shut-in phases. A test can be validated by the analysis (e.g., graphical trend analysis) of the pressure vs. cumulative volume pumped during the pumping phase of a test (as shown in FIG. 9). Since a given volume added to a closed system, results in a given (i.e., calculable) pressure increase, a valid test is ensured by the constant slope of the pressure vs. cumulative volume. If the test volumes are unchanged, the pressure vs. cumulative volume curves are parallel lines. A line that is not parallel, allows immediate diagnosis of an invalid test. Such a determination helps ensure that the test is terminated in a shorter period of time than with a conventional chart recorder.

Figure 10A:
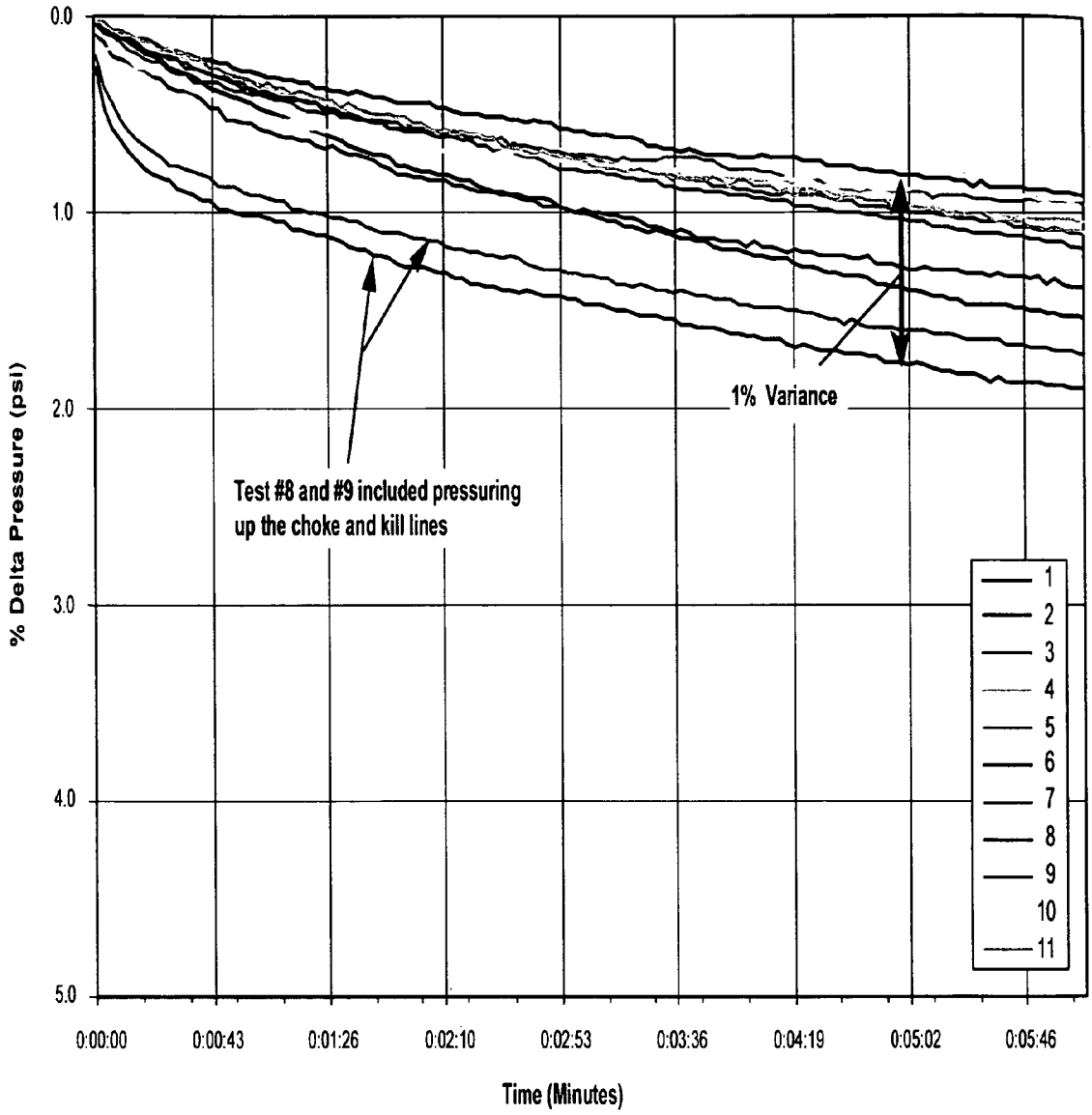
FIGS. 10A, 10B and 10C show pressure decline during the shut-in phase.
Figure 10B:
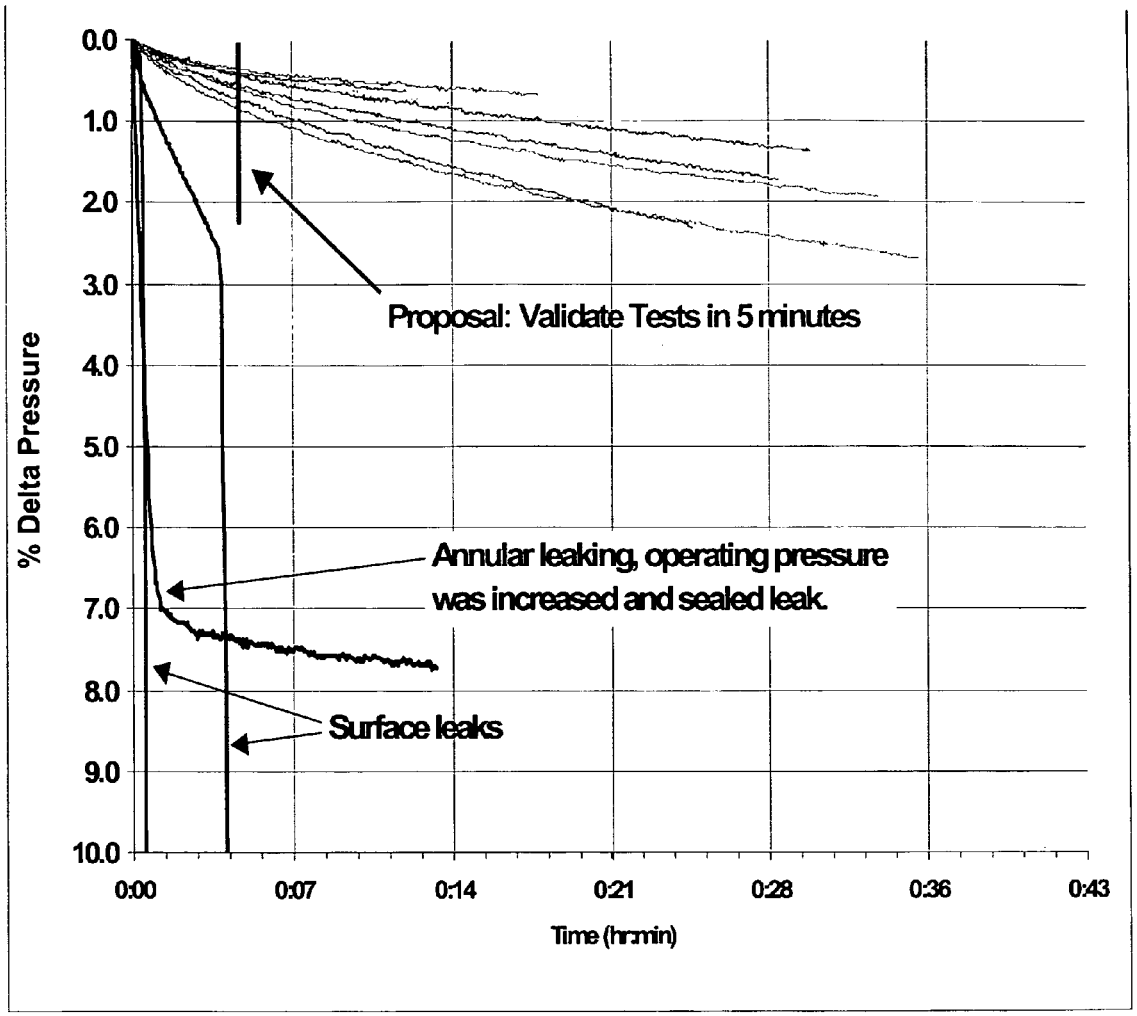
Figure 10C:
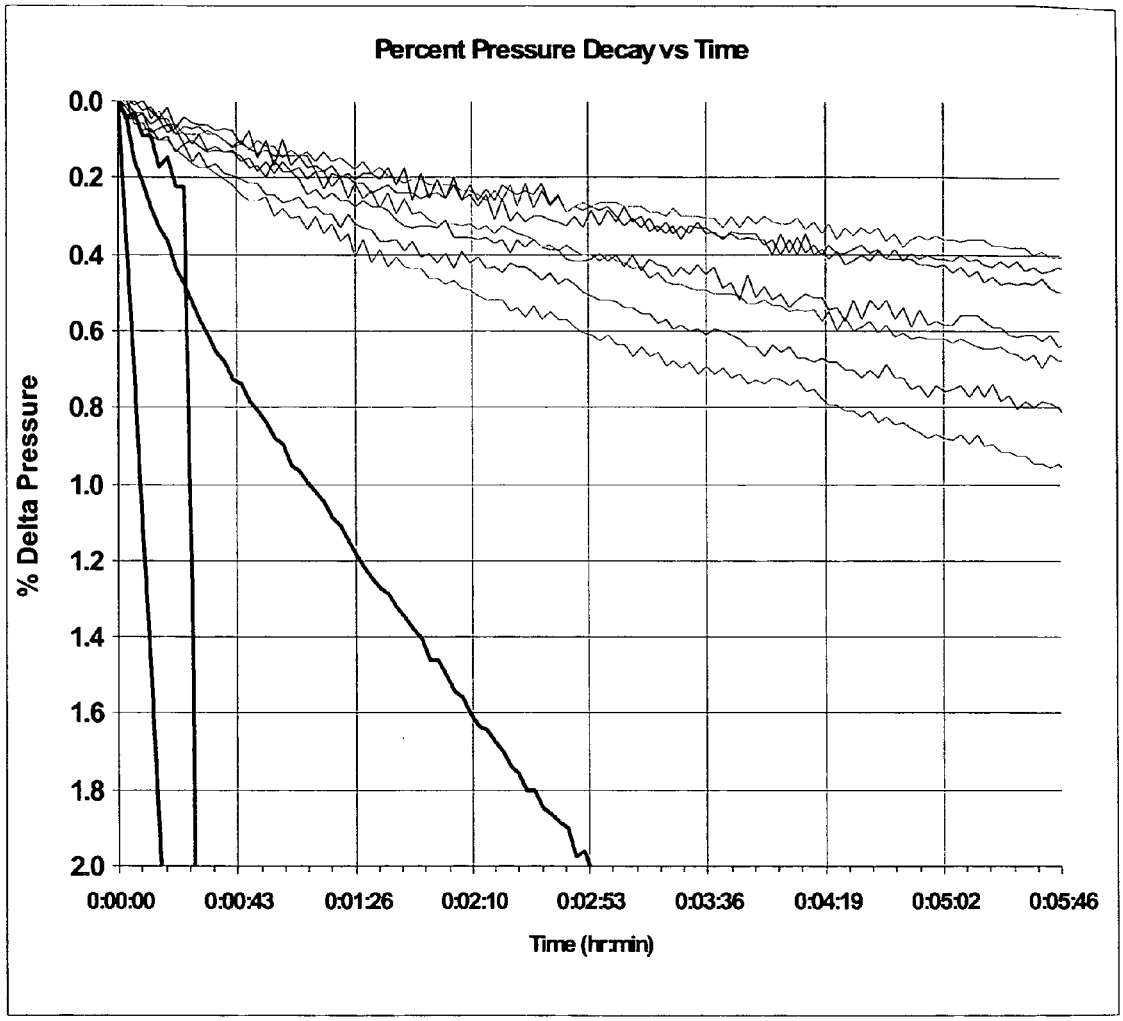

The traces of temperature and pressure vs. time during the shut-in phase show the effects of fluid cooling. The percent pressure decay vs. time curves, shown in FIG. 10, provide the basis for establishing a meaningful correlation (e.g., graphical trend analysis) between the relative pressure change and shut-in times as a function of the system parameters (i.e., the heat loss from the shut-in fluid and the system geometry). Despite variances in the data from different tests, a narrow grouping in the percent pressure change vs. time curves can be observed. The variance is within 1% of the percent change of pressure for each test. The tight band within which the pressure vs. time curves lie during the shut-in phase, and the constancy of slope (of the pressure vs. time curves) during the pumping phase, points to a methodology for validating a BOP test in real time in a fraction of the time required by current chart recorder methodology.

An analysis of the data collected shows that a test could be validated in the minimum test times required by the governing regulations.

Modeling and Leak Detection

Figure 11:
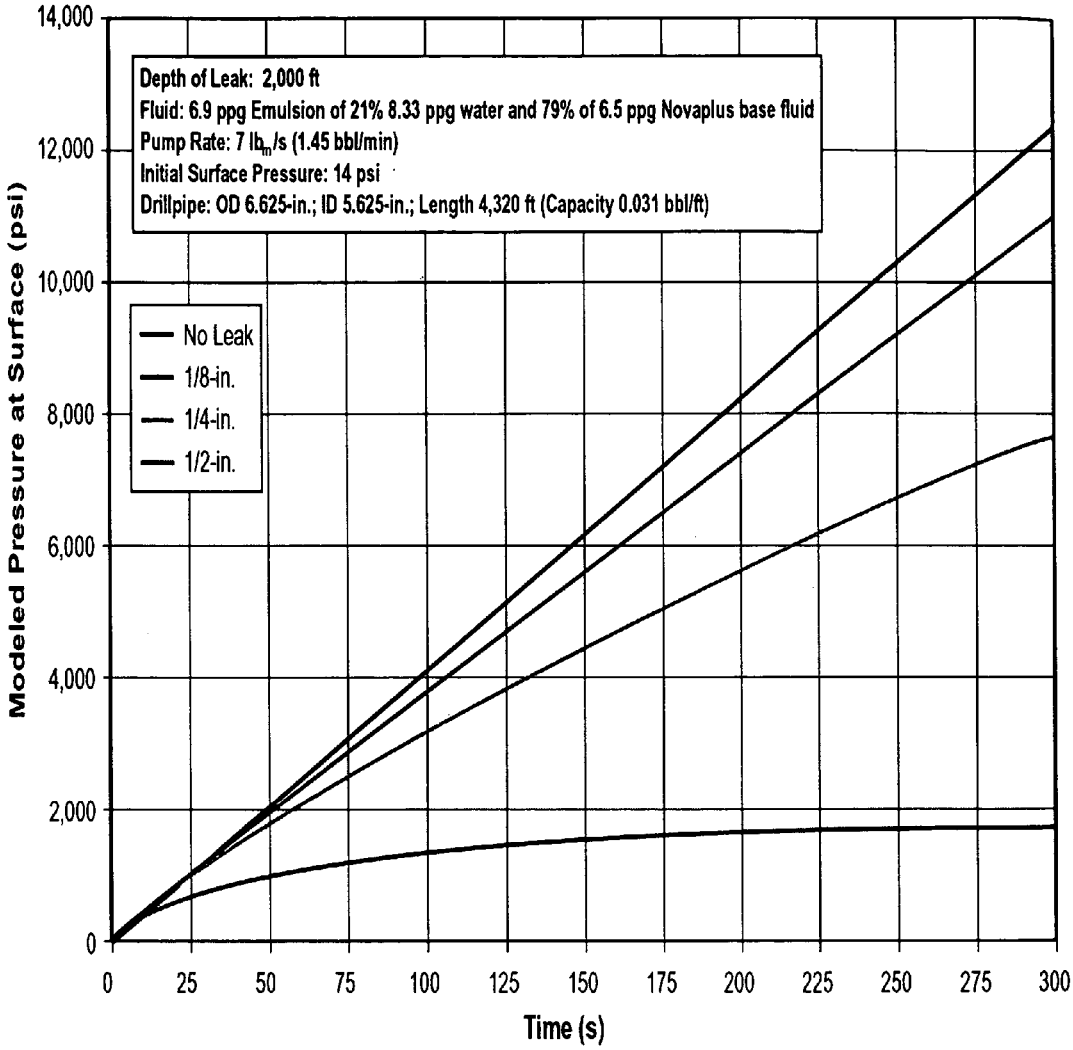
FIG. 11 depicts the behavior of surface pressure during pumping with a leak.
Figure 12:
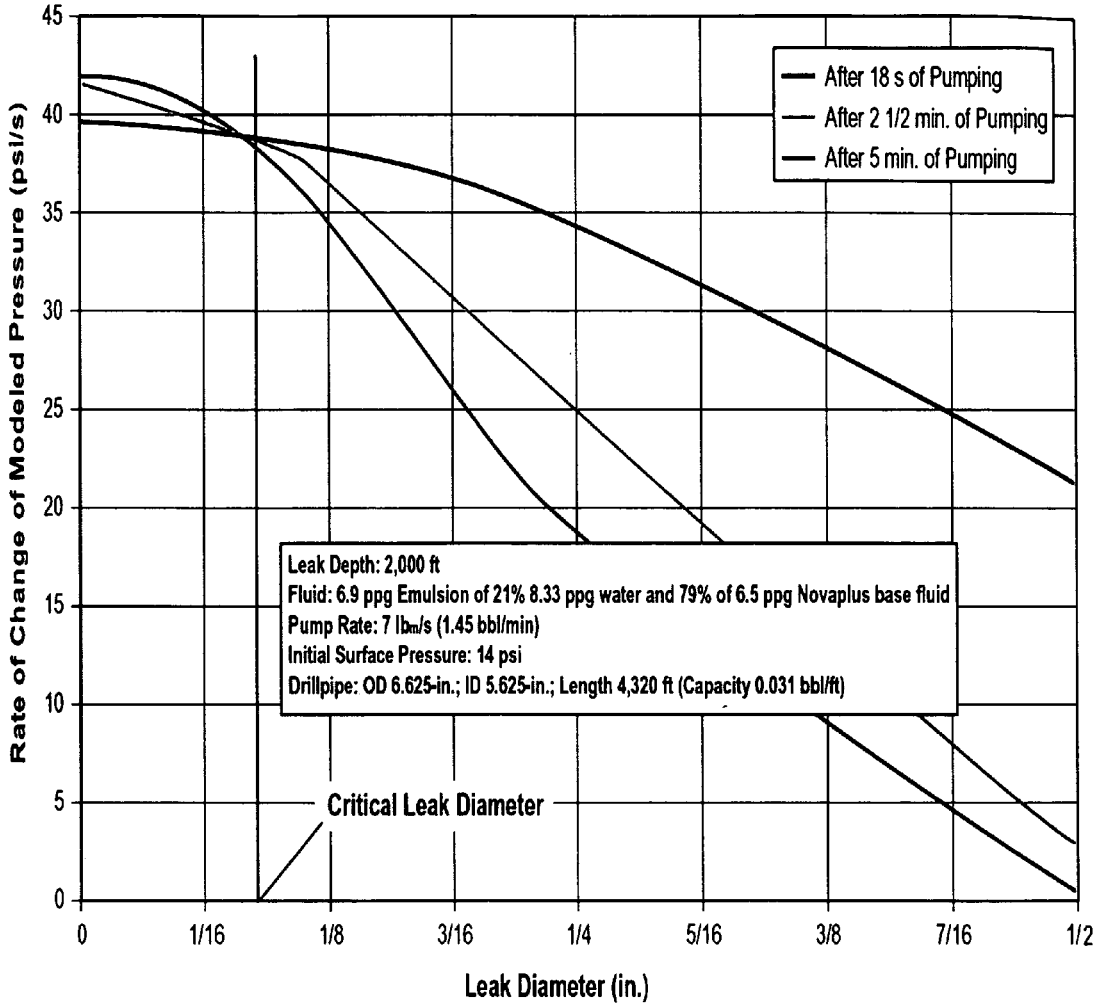
FIG. 12 shows the effect of leak size on rate of pressure change during pumping.

FIG. 11 shows the modeled pressure as a function of time for various leak sizes. The results were obtained from a simulation based on a model described in Appendix A. A leak in the test volume is characterized by its location (i.e., depth) and rate of fluid loss. The leak can occur anywhere in the test volume (pipe body, connections, valves, etc.), or in the valve being tested. Leaking fluid is assumed to flow into the drillpipe-riser annulus. In the model used to obtain FIG. 11, the rate of fluid loss ($lb_m/s$) is assumed to be proportional to $A_o\sqrt{\rho(p-p_o)}$ where "$A_o$" is the flow area of the leak, "p" is the pressure inside the drillpipe at the leak depth, "$p_o$" is the pressure to which the fluid leaks, and "ρ" is the density of the fluid inside the drillpipe. This assumption is based on the Bernoulli equation for steady flow across a nozzle (White, F. M.: *Fluid Mechanics*, second edition, McGraw-Hill, New York, N.Y. (1986), pp. 351-369). However, the properties inside the drillpipe are functions of time and location in the drillpipe, since the fluid is subjected to pressure and temperature gradients until thermal and mechanical equilibrium are established. Further, the leak is modeled as a circular orifice, so that each curve in FIG. 11 represents an equivalent leak diameter. The figure indicates that, in the absence of a leak, the pressure (at the surface) vs. time is linear as expected. This is the pressure at the surface of the drillpipe and corresponds very closely to the pressure at the exit of the CU which is the parameter monitored during a test. The figure also indicates that the pressure continues to vary linearly with respect to time when a small leak is present. This is illustrated further by FIG. 12, which shows the instantaneous pressure change (i.e., the slope of the pressure vs. time curve at a given time in FIG. 11) as a function of leak diameter. The figure indicates that the rate of change of pressure increases with time in the absence of a leak. This confirms the validity of the model since physical intuition predicts that rate of change of pressure should increase as more mass is added to the test volume. However, as the leak size increases, the rates decrease. For a given configuration, the critical leak size is determined by the relative magnitudes of the rates of pumping and fluid loss (see Appendix B).

Figure 13:
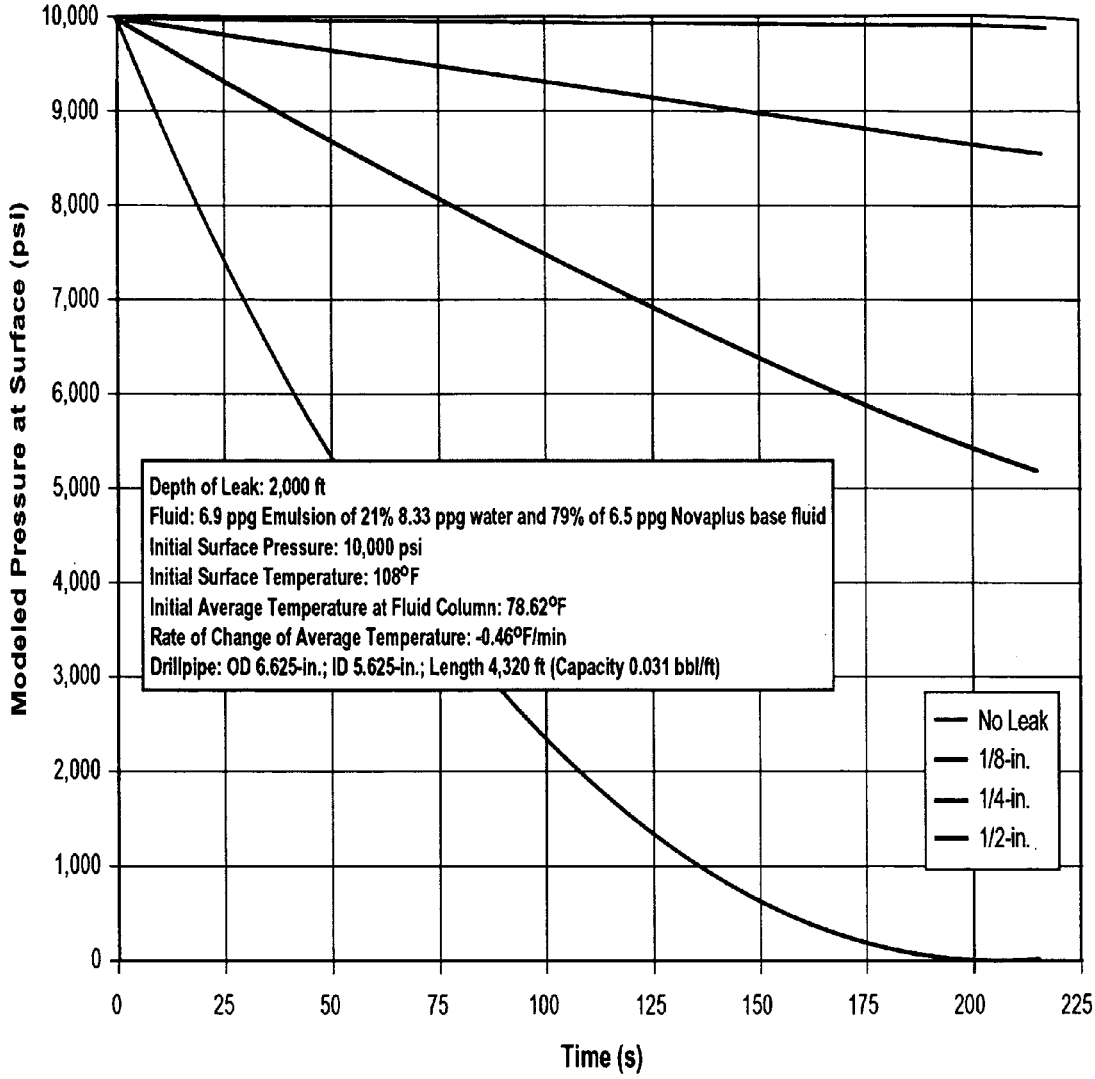
FIG. 13 depicts the behavior of surface pressure during shut-in with a leak.
Figure 14:
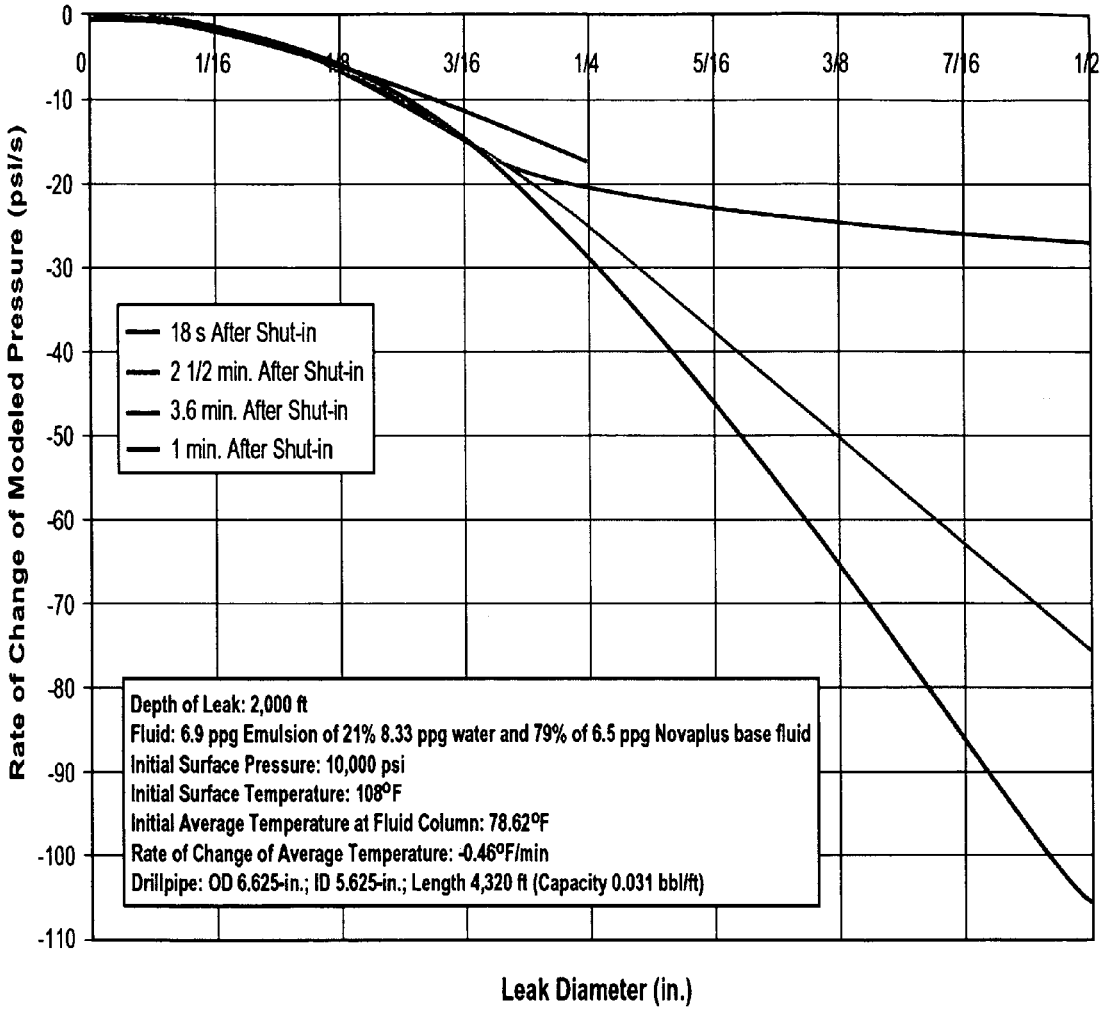

FIG. 13 shows the change of pressure during the shut-in phase. During this phase, the pressure change results from the simultaneous effects of cooling (decrease of average temperature of the fluid column) and loss of fluid through the leak. The average temperature of the fluid column is assumed to reduce at a rate of ½° F./min. This value was approximated based on the temperatures recorded by the P-T gauges and data analysis discussed in the Data Analysis and Interpretation section of this description. When there is no leak, the pressure change is determined by the average temperature change in the fluid column. Since the average density of a fluid decreases with temperature, the rate of pressure change is determined by knowing the state equation of the fluid in the test volume. Alternatively, the rate of pressure change can be estimated to be roughly given by:

$$\alpha B\frac{dT_{avg}}{dt}$$

where "α" is the isobaric coefficient of thermal expansion of the fluid, "B" is its bulk modulus, and $$\frac{dT_{avg}}{dt}$$

represents the rate of change of average fluid temperature. In the example shown in FIG. 11 and in FIG. 13, an emulsion of a synthetic base fluid and water was assumed. The thermal coefficient of expansion and the bulk modulus of the emulsion at 10,000 psi and 108° F. are $3.5\times10^{4}$/° F. and 223,657 psi, respectively. Based on the assumed rate of change of temperature shown in FIG. 13, the rate of change of pressure in the absence of a leak is estimated to be −0.6 psi/s. The initial slope of the line (corresponding to no leak) in FIG. 13 is −0.65 psi/s. The model in Appendix A (which is the basis for FIG. 13) assumes that the density of the fluid is a function of pressure and temperature and accounts for variable properties along the length of the drillpipe as a function of time. The close match between an estimated order of magnitude and the calculated value from a more detailed model confirms the validity of the model used. The pressure vs. time curves in FIG. 13 mimic the behavior displayed in FIG. 11. When the leak diameter increases (See FIG. 14), the pressure vs. time displays a quadratic behavior, which is consistent with the assumption about the rate of fluid efflux discussed earlier.

Benefits of the Methodology

Regulations require a low-pressure test before the high-pressure test. In addition:

> "Each individual pressure test must hold pressure long enough to demonstrate that the tested component(s) holds the required pressure. Each test must hold the required pressure for 5 minutes. However, for surface BOP systems and surface equipment of a subsea BOP system, a 3-minute test duration is acceptable if you record your test pressures on the outermost half of a 4-hour chart, on a 1-hour chart, or on a digital recorder ("Oil and Gas Drilling Operation," Subpart D, 30 CFR Ch. II (7-1-99 Edition))."

In accordance with the regulations and with the methodology of this invention, a conservative estimate of time savings per BOP test is 9.3 hours (see FIG. 15.) Of the 9.3 hours of time savings, 4.8 hours would be critical path time savings. Many times a test may be repeated and the time savings would be even greater. Assuming a rig tests BOPs twenty times in one year, a conservative estimate of time savings would be 186 hours. Of that, 96 hours would be critical rig path time savings. A conservative estimate of four days rig time savings per year is a significant impact especially when the consideration is for a number of rigs. Four days of rig time can easily equate to $1.5 million savings per year. In addition to time and cost savings, a large safety improvement can result from the fact that there is significantly less time exposure of personnel to high-pressure lines.

Conclusions

1) During BOP tests, the fluid heats up via the combined effects of pump friction and increased internal energy.
2) Decaying pressure vs. time was verified to be a result of the fluid cooling after being heated during the pumping phase.
3) Real-time testing methodology, utilizing digital data (e.g., graphical trend analysis) can have a significant impact on safety, as a result of minimizing exposure to high-pressure lines.
4) The methodology for validating tests can also have a substantial impact on the industry due to time and cost savings.

The method of the invention uses a computer (i.e., preferably a laptop PC) for test validation in real time. The computer is configured to record pressure and/or temperature as a function of time. Real time graphs show leaks in the BOP system during the pressure-up part of the test, as well as in the holding pressure phase of the test. Leaks are identified by deviations from the trend of other previously successful tests.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made in the shape, size and arrangement of components. This methodology is most applicable for synthetic and oil based mud systems, although it is applicable for all fluid systems. Moreover, equivalent elements may be substituted for those illustrated and described. For example, a personal digital assistant (PDA) may be used in stead of a PC. Similarly the trend analysis techniques illustrated is but one example of many other graphical techniques that may be used to validate a test long before pressure has stabilized. Parts may be reversed and certain features of the invention may be used independently of other features of the invention. For example, the benefits of the invention are not limited to submerged BOPs or deep water drilling; shelf and land-based BOP can be benefited. Thus, it will be appreciated that various modifications, alternatives, variations, and changes may be made without departing from the spirit and scope of the invention as defined in the appended claims. It is, of course, intended to cover by the appended claims all such modifications involved within the scope of the claims.

Nomenclature

| Symbol | Name | Units | Units |
|---|---|---|---|
| A(z) | Drillpipe Bore Area | $LT^{-2}$ | $in^2$ |
| B | Bulk Modulus | $ML^{-1}T^{-2}$ | psi |
| $C_p$ | Specific Heat of Fluid | $L^2T^{-2}Q^{-1}$ | BTU/lbm-° F. |
| m(t) | Mass at Time t in the Test Volume | M | lbm |
| $\dot{m}(t)$ | Rate of Change of Mass or Mass Flow Rate at Time t | $MT^{-1}$ | lbm/s |
| p(z, t) | Pressure at Depth z and Time t | $ML^{-1}T^{-2}$ | psi |
| Q(t) | Volume Flow Rate of the CU | $L^3T^{-1}$ | bbl/min |
| T(z, t) | Temperature at Depth z and Time t | Θ | ° F. |
| T | Time | $T^{-1}$ | S |
| V | Test Volume | $L^3$ | Bbl |
| Z | Depth Below Rig Surface | L | Ft |
| α | Isobaric Coefficient of Thermal Expansion of Fluid | $\Theta^{-1}$ | $°F.^{-1}$ |
| β | Isothermal Fluid Compressibility | $M^{-1}LT^2$ | $psi^{-1}$ |
| ρ(z, t) | Fluid Density at Depth z and Time t | $ML^{-3}$ | ppg |

-continued

Nomenclature

Subscripts

| | |
|---|---|
| e | Condition at Exit or at the Leak |
| i | Condition at Inlet |
| L | Condition at Depth of Leak |
| o | Initial Value |

REFERENCES

1) "Oil and Gas Drilling Operation," Subpart D, 30 CFR CH. II (Jul. 1, 1999 Edition).
2) Wittmer, G. X.: "Recording Apparatus for Fluid Meters," U.S. Pat. No. 716,973 (1902).
3) Van Wylen, G. J. and Sonntag R. E.: *Fundamentals of Classical Thermodynamics*, John Wiley and Sons, Inc., New York City, N.Y. (1973).
4) Halal, A. S. and Mitchell, R. F.: Casing Design for Trapped Annulus Pressure Buildup," paper SPE/IADC 25694 presented at the 1993 IADC/SPE Drilling Conference.
5) Payne, M. L., Pattillo, P. D., Sathuvalli, U. B., Miller, R. A., and Livesay, R.: "Advanced Topics for Critical Service Deepwater Well Design," presented at 2003 *Deep Offshore Technology* (*DOT*), Marseille, France, November 19-21.
6) Zamora, M., Broussard, P. N., and Stephens, M. P.: "The Top Ten Mud-Related Concerns in Deepwater Drilling," paper SPE 59109 presented at the 2000 *SPE International Petroleum Conference and Exhibition*, Villa Hermosa, Mexico, February 1-3.
7) White, F. M.: *Fluid Mechanics*, second edition, McGraw-Hill, New York, N.Y. (1986), pp 351-369.
8) Timoshenko, S.: *Strength of Materials, Part 2, Advanced Theory and Problems*, third edition, D. Van Nostrand Company, Princeton, N.J. (1968), pp. 205-210.
9) Chapman, A. J.: *Fundamentals of Heat Transfer*, Macmillan, New York, N.Y. (1984).
10) ANSI/ASME Measurement Uncertainty Code, ANSI/ASME PTC 19.1-1985, American Society of Mechanical Engineers, New York, N.Y. (1986).

Appendix A: Modeling the Test Process

Let p(z, t) and T(z, t) denote the pressure and temperature in the drillpipe fluid at a depth z and time t. With reference to FIG. 1, depth z=0 corresponds to the surface of the rig. The origin for time is arbitrary and can be chosen when pumping begins. The density p(z, t) of the fluid in the drillpipe is a function of pressure and temperature. Therefore, the density varies with time and location in the drillpipe. Further, if A(z) denotes the drillpipe bore area of the drillpipe at depth z, the mass of fluid m(t) in the drillpipe (test volume) at any time t is given by:

$$m(t) = \int_{DP} \rho(z, t)A(z)dz \tag{A-1}$$

where DP denotes the region of integration and extends from the top of the drillpipe to the depth where it is plugged (e.g., a test plug inserted at the wellhead or lower end of the BOP). Let $\dot{m}_i(t)$ denote the instantaneous mass flow rate at which fluid is added to the test volume. Also, assume that a leak exists at a depth $z_L$ and that the instantaneous mass flow rate of the fluid exiting the leak is $\dot{m}_o(t)$. Conservation of mass requires that:

$$\dot{m}_i(t) - \dot{m}_o(t) = \frac{dm(t)}{dt} \tag{A-2}$$

where m(t) is defined in Eq. A-1. In the test process, $\dot{m}_i(t)$ is generally known from the volume flow rate Q(t) (bbl/min) generated by the CU. If $\rho_o$ is the density of the fluid at rig surface temperature and pressure, the instantaneous mass flow rate into the test volume is:

$$\dot{m}_i(t)=\rho_o Q(t). \tag{A-3}$$

The rate of fluid loss from the leak is determined by assuming that the leak is at a depth $z_L$. The flow across the leak is driven by the difference between the instantaneous internal pressure in the drillpipe at this depth and the external pressure $p_o(z)$. This external pressure is immediately downstream of the leak and it may be assumed to represent the hydrostatic pressure of the fluid in the drillpipe-riser annulus at the leak depth $z_L$. If viscous flow losses across the leak are neglected, the steady-state Bernoulli equation may be applied to determine the flow velocity across the leak. This is essentially equivalent to assuming that the potential energy of the fluid due to the hydrostatic head is converted entirely to flow energy. This is a standard approach used to determine inviscid flow through orifices (White, F. M.: *Fluid Mechanics*, second edition, McGraw-Hill, New York, N.Y. (1986), pp 351-369.). Therefore, the mass flow rate exiting the test volume can be shown to be given by:

$$\dot{m}_o(t) = \begin{cases} A_o\sqrt{2\rho(z_L, t)[p(z_L, t) - p_o(z_L, t)]}, & p(z_L, t) > p_o(z_L, t) \\ 0, & p(z_L, t) < p_o(z_L, t) \end{cases} \tag{A-4}$$

Note that the right-hand side (RHS) of Eq. A-4 is a function of time. Since the density and the pressure are changing continuously, expression for $\dot{m}_o(t)$ is valid for small intervals of time, so that the assumption of constant pressure and density inside the drillpipe are justified. Further, note that the mass flow rate is zero when the drillpipe pressure is less than the pressure outside the leak or when the leak area $A_o$ is zero. The instantaneous net rate of change of net mass in the drillpipe is determined by substituting Eqs. A-3 and A-4 into Eq. A-2.

If flow losses caused by a leak are neglected, force balance requires that:

$$\frac{dp(z, t)}{dz} = \rho(z, t)g \tag{A-5}$$

where "g" denotes the acceleration due to gravity. (If the density is measured in ppg and the pressure gradient in psi/ft, g in the RHS of Eq. A-5 is replaced by the conversion factor 0.0519.) Eq. A-5 states that hydrostatic conditions prevail in the drillpipe at all times. This is a reasonable assumption, unless the leak is copious and the leak area is comparable to the drillpipe bore area. Since the aim of the model is to detect small leaks, it is reasonable to assume that quasi-hydrostatic conditions prevail at all times. Also, note that the added fluid behaves more like a slug of fluid that compresses the original fluid inside the drillpipe.

The state equation for the fluid describes the density of the fluid as a function of pressure and temperature:

$$\rho=\rho(p,T) \tag{A-6}$$

The state equation allows the determination of the density in the drillpipe as a function of depth at any given time, provided the local pressure and temperature are known.

During the pumping phase, the fluid undergoes compression. The rate of change of temperature due to the compressive work done on the fluid is given by:

$$\frac{dT(z, t)}{dt} = \begin{cases} \frac{1}{C_p}\frac{p(z, t)}{[\rho(z, t)]^2}\frac{d\rho(z, t)}{dt} & \frac{d\rho(z, t)}{dt} > 0 \\ 0 & \frac{d\rho(z, t)}{dt} < 0 \end{cases} \tag{A-7}$$

where "$C_p$" denotes the specific heat of the fluid at constant pressure. Note that compressive work is done only when the local density increases. Local density decreases are accompanied by local cooling, which is neglected in this model. Finally, in addition, the temperature change described by Eq. A-7, the fluid experiences temperature changes due to heat transfer by the following mechanisms:

1) Addition of hot fluid from the CU during the pumping phase
2) Heat loss to the ambient sea The hot fluid added from the CU transfers heat to the cooler fluid (that is originally present) in the drillpipe mainly by conduction. The temperature profile at any point in the drillpipe is thus determined by the competing effects of conduction from the hot slug of pumped fluid and convection to the ambient sea from the drillpipe outside diameter (OD). Modeling the heat transfer in the drillpipe involves the computation of a transient heat conduction process. Here, the temperature profiles are assumed or estimated based on the analysis of the data gathered from the downhole P-T gauges installed in the drillpipe.

If the instantaneous temperature profile is known in the drillpipe, the simultaneous equations, Eqs. A-2, A-5, and A-6 can be solved numerically. Use of the state equation (Eq. A-6) can ensure that the variation of thermophysical properties of the drilling mud with depth and time are properly accounted.

Finally, an unstated assumption that underlies Eq. A-1 is examined. The drillpipe bore area A(z) was assumed constant. The variation of the drillpipe OD and inside diameter (ID) with pressure and temperature changes has not been included. In the tests described in this paper, a thick-walled 6⅝-in drillpipe (0.500-in. WT) was used. Application of Lame's equation for a cylinder (Timoshenko, S.: *Strength of Materials, Part 2, Advanced Theory and Problems*, third edition, D. Van Nostrand Company, Princeton, N.J. (1968), pp. 205-210) indicated that the drillpipe volumetric strain for a 12,000-psi change of pressure at surface was of the order of 0.08%. The compressive volumetric strain caused by added fluid during the pumping phase was of the order of 3.5%. Therefore, neglecting the increase of the drillpipe volume due to pressurization does not lead to appreciable error. If thinner wall drillpipe is used, the term A(z) must be modified by using Lame's equations, so that it becomes a function of the instantaneous pressure in the drillpipe and hence a function of time.

Appendix B: The Critical Leak Size

Consider a rigid container of volume V into which fluid is pumped at a rate $\dot{m}_i(t)$. Let fluid be lost via the leak at a rate $\dot{m}_e(t)$. The notion of a critical leak size is best illustrated by assuming that the pressure, temperature, and density of the fluid are uniform throughout the container at any given time. Mass is conserved in the container according to Eq. A-2 of Appendix A. If the density of the fluid at a given instant of time is constant throughout the container, Eq. A-1 becomes:

$$m(t)=V\rho(t). \tag{B-1}$$

Substitution of Eq. B-1 into Eq. A-2 yields the following relation for the rate of change of fluid density in the container:

$$\frac{d\rho(t)}{dt} = \frac{\dot{m}_i(t) - \dot{m}_e(t)}{V} \tag{B-2}$$

The state equation for the fluid (i.e., Eq. A-6) can be used to obtain an expression for the change in density ($\delta\rho$) required due to an infinitesimal changes in temperature ($\delta T$) and pressure ($\delta p$), so that:

$$\begin{aligned}\frac{\delta\rho(p,T)}{\rho(p,T)} &= \frac{1}{\rho(p,T)}\frac{\partial\rho(p,T)}{\partial T}\bigg|_P \delta T + \frac{1}{\rho(p,T)}\frac{\partial\rho(p,T)}{\partial P}\bigg|_T \delta p \\ &= \alpha\delta T + \beta\delta p\end{aligned} \tag{B-3}$$

In Eq. B-3, the coefficients of $\delta T$ and $\delta P$ are the isobaric coefficient of thermal expansion $\alpha$ and the isothermal compressibility of the fluid $\beta$ respectively (Chapman, A. J.: *Fundamentals of Heat Transfer*, Macmillan, New York, N.Y. (1984). Note that the reciprocal of $\beta$ is commonly referred to as the "bulk modulus". Although $\alpha$ and $\beta$ are functions of pressure and temperature, they are treated as constants in this Appendix B.

By combining Eq. B-3 with Eq. B-2, and then substituting the expression for the rate of mass efflux given in Eq. A-4, the following equation for the rate of pressure change is obtained:

$$\frac{dp(t)}{dt} = \frac{1}{\beta}\left[\frac{\dot{m}_i}{m} - \alpha\frac{dT(t)}{dt}\right] - \frac{1}{\beta m}A_o\sqrt{\frac{2m[p(t)-p_o]}{V}},\ p(t) > p_o. \tag{B-4}$$

Eq. B-4 relates the instantaneous pressure to the rate of change of temperature ($dT(t)/dt$) due to cooling or heating of the fluid, and the rates of fluid entering and leaving the container. The first term on the RHS Eq. B4 describes the pressure change due to mass influx and temperature change. The term $$\frac{\dot{m}_i}{m}$$

describes the volumetric compressive strain rate in a rigid container. The term $$\alpha\frac{dT(t)}{dt}$$

denotes the volumetric strain rate due to thermal expansion of the fluid. The rate of mass exiting the container is given by $$\sqrt{\frac{2m[p(t)-p_o]}{V}},$$

so that $$\frac{1}{m}\sqrt{\frac{2m[p(t)-p_o]}{V}}$$

is the volumetric strain rate due to fluid loss from the leak. Multiplying the strain rate by the reciprocal of the compressibility yields the rate of pressure change. Therefore, the relative magnitude of the rate of pressure change due to: mass influx and temperature change vs. fluid loss from the leak is indicated by the ratio of the two terms on the RHS of Eq. B-3.

FIG. 8 illustrates the pressure decay for the various tests during the shut-in phase. Though the test volumes and the peak pressures do not vary significantly across the tests (with the exception of Tests #8 and #9), the pressure vs. time data shows some scatter, due to the inevitable variation of parameters (e.g., changes in ambient temperature, variation of properties of added fluid, changing sea conditions, etc.) that control the pressure. In addition, the measurement error (in the pressure transducer and the data acquisition system) contributes to the scatter shown in FIG. 9. Therefore, the pressure measurement is characterized by an "error band" that is a function of the uncertainty/variability in the system parameters and the measuring system. The error band can be quantified by using standard techniques of uncertainty analysis (ANSI/ASME Measurement Uncertainty Code, ANSI/ASME PTC 19.1-1985, American Society of Mechanical Engineers, New York, N.Y. (1986)). The critical leak size is the smallest leak that can be detected unambiguously. In the light of this description, the smallest identifiable leak is that which generates a pressure that lies outside the "error band" of a valid test.

I claim:

1. In a system comprising: a blowout preventer (BOP) having an upper end and a wellhead end, having a throughbore between the ends, and at least one valve for closing the throughbore; a cementing unit for providing pressurized fluid; and piping for connecting the output of the cementing unit to the BOP and into the throughbore of the BOP, a method comprising the steps of:

a) using a pipe to install in the throughbore a test plug adjacent to the wellhead end of the BOP and in fluid communication with the interior of said pipe and the wellhead side of the valve;

b) shutting the valve in the BOP against the exterior of said pipe;

c) using the cementing unit and the piping to increase the pressure in the throughbore to a predetermined level;

d) displaying the pressure in the piping as a function of time; and e) displaying the pressure in the piping as a function of time for the same blowout preventer system at an earlier time for which leakage was deemed to be within predetermined acceptable limits, wherein the time over which pressure is displayed in step (d) is less than the time over which pressure is displayed in step (e).

2. The method of claim 1, wherein the cementing unit comprises pressure gauge means for producing a signal that is representative of the pressure within said piping.

3. The method of claim 2, further including a computer having a) an input for receiving said signal from said pressure gauge means; b) means for converting said signal into a graphic display of the pressure in the piping as a function of time.

4. The method of claim 3, wherein said computer has a memory for storing a plurality of values representing the time and the corresponding pressure in the BOP system for piping pressurization performed at different dates.

5. The method of claim 4, wherein said plurality of values include at least one piping pressurization performed at a date when leakage was deemed to be within a predetermined acceptable limit.

6. The method of claim 3, wherein said computer is a laptop computer located in the vicinity of the cementing unit.

7. The method of claim 1, wherein the cementing unit pumps a synthetic based mud.

8. The method of claim 1, wherein the cementing unit pumps a mud whose temperature increases with increased pressure.

9. The method of claim 1, further including the step of displaying the change of pressure in the piping over time.

10. The method of claim 1, further including the step of displaying the time rate of change of pressure in the piping over time.

11. In a blowout preventer (BOP) having an upper end and a wellhead end, having a throughbore between the ends, and at least one valve for closing the upper end of the throughbore; a cementing unit, piping for connecting the output of the cementing unit to the throughbore of the BOP, and pressure gauge means for producing a signal that is representative of the pressure within said throughbore, a method comprising the steps of:

a) using a pipe passing into the upper end of the throughbore to install in the throughbore a test plug adjacent to the wellhead end of the BOP to seal the wellhead end of the throughbore;

b) shutting the valve in the BOP against the exterior of said pipe to seal the upper end of the throughbore;

c) using the cementing unit and said piping to increase the pressure in the throughbore to a predetermined level;

d) depicting the pressure in the throughbore of the BOP as a function of time by using a laptop computer having an input for receiving the signal from the pressure gauge means, having a visual display, and having means for periodically converting said signal into a image on said display; and e) depicting the pressure in the throughbore of the BOP as a function of time for the same blowout preventer system at an earlier time for which leakage from the BOP system was deemed to be within predetermined acceptable limits, said computer having a memory for storing a plurality of values representing the time and the corresponding pressure in the BOP system for a system pressurization performed at different dates, and having at least one system pressurization performed at a date when leakage was deemed to be within a predetermined acceptable limit wherein the time over which pressure is depicted in step (d) is less than the time over which pressure is depicted in step (e).

* * * * *